US011780619B2

(12) United States Patent
Christel et al.

(10) Patent No.: US 11,780,619 B2
(45) Date of Patent: Oct. 10, 2023

(54) SYSTEMS FOR PACKAGING STACKS OF BAGS

(71) Applicant: H.G. Weber and Company, Inc., Kiel, WI (US)

(72) Inventors: Alex Christel, Kiel, WI (US); Ben Davidson, Kiel, WI (US); Pat Kiel, Kiel, WI (US); Ryan Thiem, Kiel, WI (US)

(73) Assignee: H.G. Weber and Company, Inc., Kiel, WI (US)

( * ) Notice: Subject to any disclaimer, the term of this patent is extended or adjusted under 35 U.S.C. 154(b) by 52 days.

(21) Appl. No.: 17/162,849

(22) Filed: Jan. 29, 2021

(65) Prior Publication Data

US 2021/0237916 A1 Aug. 5, 2021

Related U.S. Application Data

(60) Provisional application No. 62/967,922, filed on Jan. 30, 2020.

(51) Int. Cl.

| | |
|---|---|
| ***B65B 11/48*** | (2006.01) |
| ***B65B 49/08*** | (2006.01) |
| ***B65B 59/00*** | (2006.01) |
| ***B65B 57/10*** | (2006.01) |
| ***B65B 35/36*** | (2006.01) |

(52) U.S. Cl.

CPC ..... *B65B 11/48* (2013.01); *B65B 35/36* (2013.01); *B65B 49/08* (2013.01); *B65B 57/10* (2013.01); *B65B 59/001* (2019.05)

(58) Field of Classification Search

CPC ... B65B 49/00–16; B65B 57/10; B65B 35/36; B65B 59/001; B65B 11/48

See application file for complete search history.

(56) References Cited

U.S. PATENT DOCUMENTS

| | | | | |
|---|---|---|---|---|
| 3,855,758 | A * | 12/1974 | Walter | B65B 11/22 53/226 |
| 4,624,096 | A * | 11/1986 | Nordstrom | B65B 51/16 53/590 |
| 6,067,780 | A * | 5/2000 | Gentili | B65B 25/146 53/376.2 |
| 7,131,246 | B2 * | 11/2006 | Dall'Omo | B65B 11/22 53/232 |
| 7,290,382 | B2 * | 11/2007 | Imao | B65B 49/08 53/173 |
| 7,703,264 | B2 * | 4/2010 | Giuliani | B65B 9/067 53/550 |

(Continued)

*Primary Examiner* — Anna K Kinsaul
*Assistant Examiner* — Himchan Song
(74) *Attorney, Agent, or Firm* — ANDRUS INTELLECTUAL PROPERTY LAW, LLP

(57) ABSTRACT

A system for end-folding a wrapping onto a stack of bags includes a folding machine having a first folding station and a second folding station. The first folding station configured to receive the stack of bags with the wrapping partially covering the stack of bags and defining wrapping flaps, and is further configured to end-fold one or more of the wrapping flaps of the wrapping onto the stack of bags while leaving other flaps unfolded. The second folding station is downstream from the first folding station is configured to receive the stack of bags from the first folding station and further end-fold unfolded wrapping flaps of the wrapping onto the stack of bags.

12 Claims, 27 Drawing Sheets

(56) References Cited

U.S. PATENT DOCUMENTS

| | | | | |
|---|---|---|---|---|
| 7,707,805 | B2 * | 5/2010 | Gorrieri | B65B 59/001 53/540 |
| 2009/0139185 | A1 * | 6/2009 | Gorrieri | B65B 25/146 53/251 |
| 2012/0011808 | A1 * | 1/2012 | Langen | B65B 43/145 53/235 |
| 2014/0260087 | A1 * | 9/2014 | Antoniazzi | B65B 11/20 53/204 |
| 2017/0197743 | A1 * | 7/2017 | Jones | B65B 49/08 |
| 2019/0039762 | A1 * | 2/2019 | Toro | B65B 59/001 |
| 2020/0010226 | A1 * | 1/2020 | Draghetti | B29C 66/8432 |

* cited by examiner

SYSTEMS FOR PACKAGING STACKS OF BAGS

CROSS-REFERENCE TO RELATED APPLICATION

The present disclosure claims priority to U.S. Provisional Patent Application No. 62/967,922 filed Jan. 30, 2020, the disclosure of which is incorporated herein by reference.

FIELD

The present disclosure relates to systems for packaging stacks of bags, and specifically to systems that package stacks of bags in foldable wrappings.

BACKGROUND

This Background is intended to introduce various aspects of the art, which may be associated with the present disclosure to thereby assist in providing a framework to facilitate a better understanding of particular aspects of the present disclosure. Accordingly, this Background should does not necessarily constitute admissions of prior art.

Paper, cloth, and plastic bags are widely used in the retail industry for packaging goods, e.g., groceries, clothing, etc. Specialized forming machines create the bags with one or more materials such as paper, plastic, and/or cloth. These forming machines create bags with a specific, consistent size and/or shape and further collect the bags into stacks of bags (commonly referred to as "hands" of bags). For example, a single forming machine can produce stacks of 8"×12"×6" dimensioned bags or 10"×16"×6" dimensioned bags.

The applicants recognized it would be beneficial to develop systems positioned downstream of bag forming machines that receive different sizes and/or shapes of stacks of bags, fold packaging wrappings onto the stacks of bags, and dispense fully packaged stacks of bags for shipping. Accordingly, through research and experimentation, the applicants developed the systems of the present disclosure described herein.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a system for end-folding a wrapping onto a stack of bags includes a folding machine having a first folding station and a second folding station. The first folding station is configured to receive the stack of bags with the wrapping partially covering the stack of bags. The wrapping defines a plurality of wrapping flaps extending outwardly from the stack of bags. The first folding station is further configured to end-fold one or more wrapping flaps of the wrapping onto the stack of bags while leaving at least one wrapping flap unfolded. The second folding station is downstream from the first folding station and is configured to receive the stack of bags from the first folding station and further configured to end-fold the unfolded wrapping flaps of the wrapping onto the stack of bags.

In certain examples, a method for end-folding a wrapping onto a stack of bags includes receiving the stack of bags partially wrapped in the wrapping into a first folding station; end folding, with the first folding station, one or more wrapping flaps of the wrapping onto the stack of bags; further end folding, with a second folding station, unfolded wrapping flaps onto the stack of bags; and dispensing the stack of bags wrapped with the wrapping.

In another embodiment, a folding machine for packaging a stack of bags in a wrapping, is disclosed. The folding machine includes a first folding station configured to receive the stack of bags with the wrapping partially covering the stack of bags such that a plurality of wrapping flaps of the wrapping extend from exposed sides of the stack of bags. The first folding station is further configured to end-fold at least one wrapping flap of the plurality of wrapping flaps onto at least one side of the exposed sides of the stack of bags while leaving at least one of the plurality of wrapping flaps unfolded. The first folding station further includes a plurality of bullnoses to fold the wrapping flaps relative to the stack of bags. The machine includes a second folding station configured to receive the stack of bags from the first folding station and end-fold the remaining unfolded wrapping flaps of the plurality of wrapping flaps onto the exposed sides of the stack of bags. The machine also includes a controller that controls the movement of the stack of bags relative to a plurality of bullnoses based on the dimensions of the stack of bags. Dimensions of the stack of bags may be stored on a memory of the controller, received via a user input, or determined by sensors that are coupled to the controller and configured to sense dimensions of the stack of bags.

A method for end-folding a wrapping onto a stack of bags is also disclosed. The method contemplates receiving the stack of bags partially wrapped in a wrapping having a plurality of wrapping flaps into a first folding station. The first folding station then end folds one or more wrapping flaps of the wrapping onto the stack of bags while leaving at least one wrapping flap unfolded. A second folding station further end folds at least one of the unfolded wrapping flaps onto the stack of bag. The method then contemplates dispensing the stack of bags wrapped with the wrapping.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
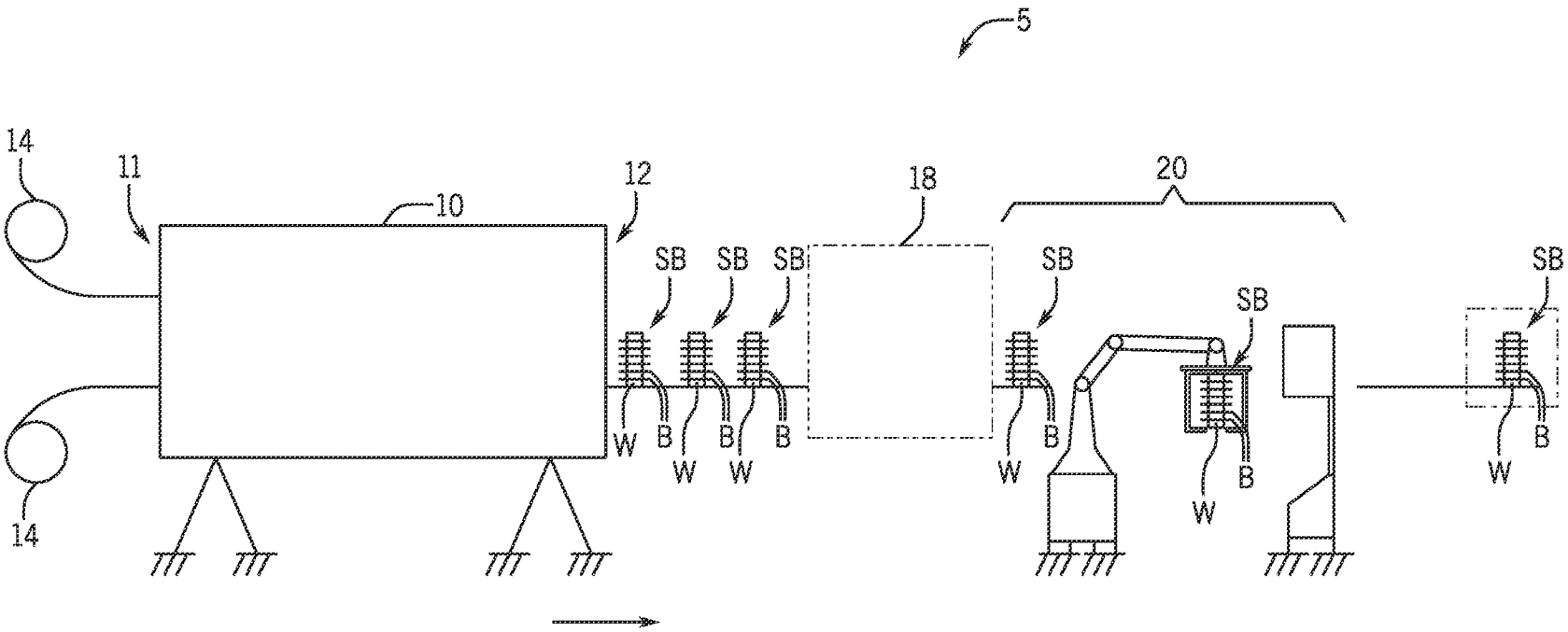
FIG. 1 is a schematic view of an example folding system of the present disclosure.

FIG. 1 depicts a schematic view of an example system 5 for forming, stacking, and wrapping stacks of bags. The system 5 includes a forming machine 10 that forms and dispenses bags B downstream to other sections and/or components of the system 5. The forming machine 10 has an upstream end 11 configured to receive materials, such as paper webs, plastic webs, and cloth webs from corresponding material rolls 14 and an opposite downstream end 12 that dispenses formed bags B. The forming machine 10 can include different devices and/or components that form the material webs into bags B.

Figure 2:
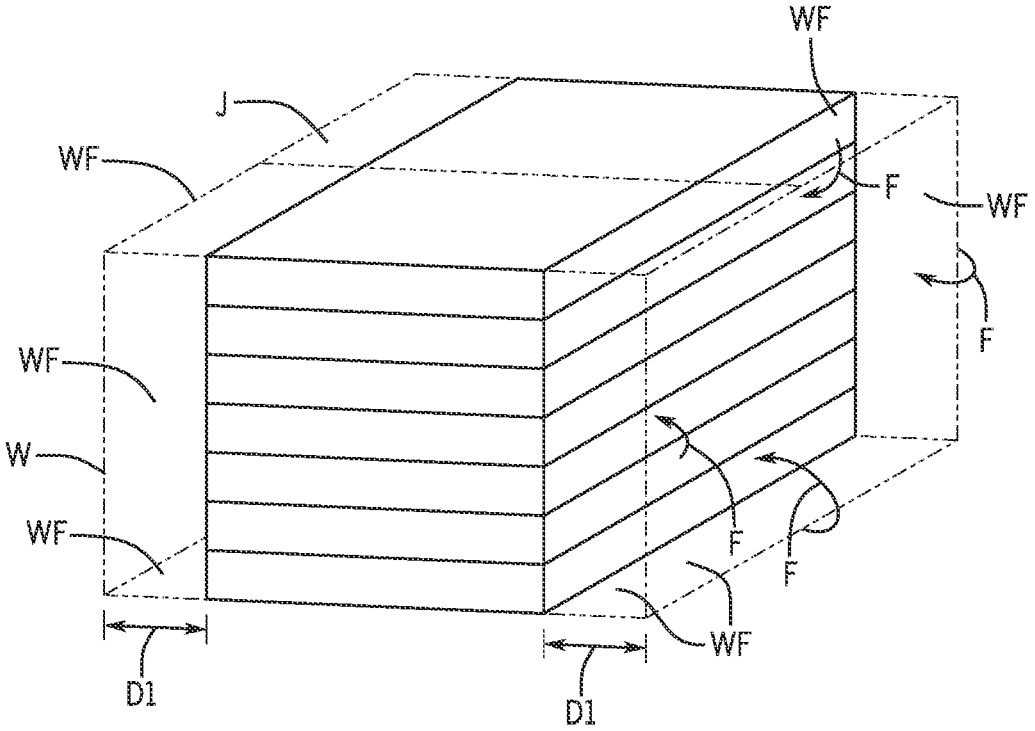
FIG. 2 is a perspective view of an example stack of bags with a wrapping on four sides of the stack of bags.
Figure 32A:
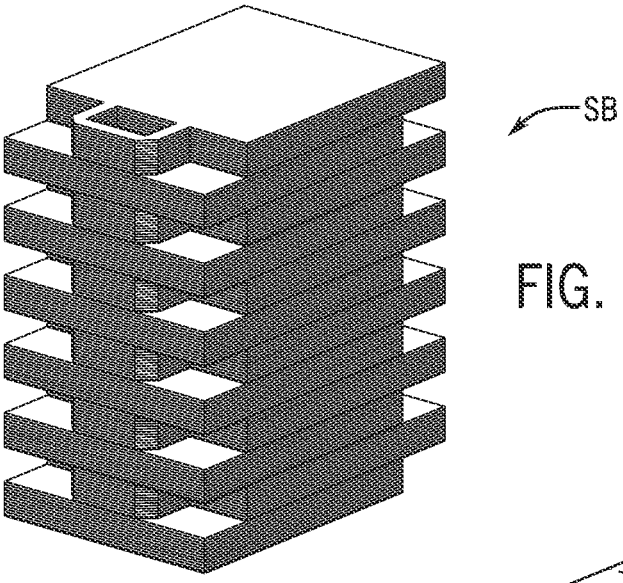
FIG. 32A is a perspective view of an example stack of bags without wrapping thereon.
Figure 32B:
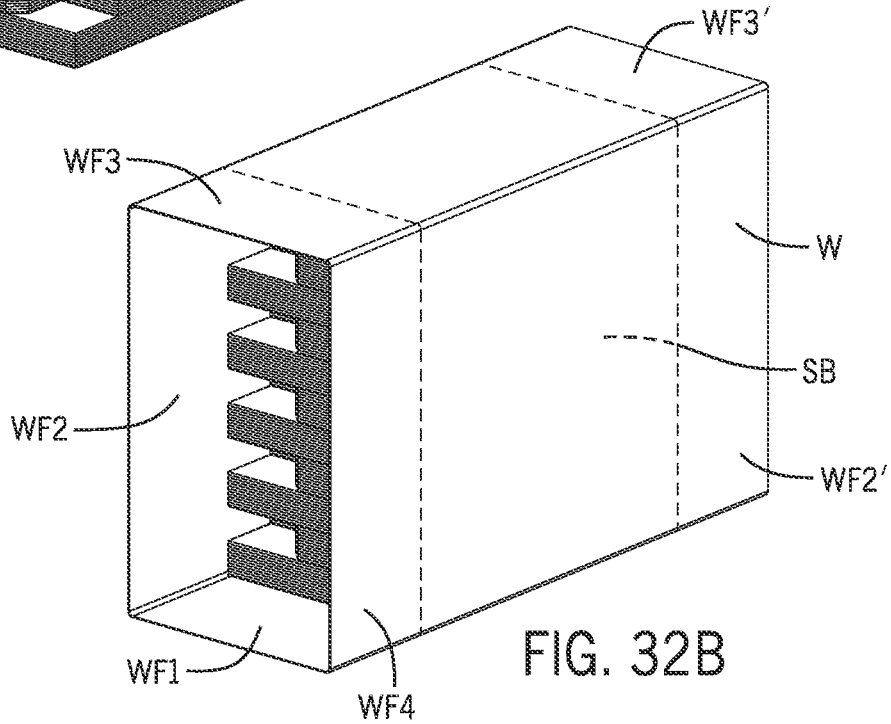
FIG. 32B is a perspective view of an example stack of bags with wrapping encircling the stack of bags. Wrapping flaps extend from ends of the stack of bags.

After the bags B are formed, the forming machine 10 stacks multiple bags B into stacks of bags SB (see FIG. 32A for an example unwrapped stack of bags SB). The stacks of bags SB are partially wrapped in a packaging wrapping W (depicted in dashed lines on FIG. 2; see also FIG. 32B for an example partially wrapped stack of bags SB). The wrapping W is generally a planar, rectangular sheet of material, such as paper or plastic, and the forming machine 10 folds or wraps the wrapping W onto four sides of the stack of bags SB and secures ends of the wrapping W adhesive at a joint J such that two opposing sides of the stack of bags SB remain uncovered or exposed (see FIG. 2). Note that the wrapping W has wrapping flaps WF that extend outwardly from the uncovered or exposed sides of the stack of bags SB. Note that wrapping flaps WF extend a distance D1 from the uncovered or exposed sides of the stack of bags SB, and note that the wrapping flaps WF extend around the perimeters of the uncovered or exposed sides of the stack of bags SB. Accordingly, the forming machine 10 first partially packages the stack of bags SB in the wrapping W (as depicted in FIGS. 2 and 32B). In another example, the forming machine 10 dispenses the bags B downstream without stacking or wrapping the bags B. In this example, a downstream machine stacks the bags B and wraps the stacks of bags SB with the wrapping W. In another example, the system 5 does not include the forming machine 10 noted above and the system 5 receives pre-formed stacks of bags SB from other machines or conveyors. In still other examples, the system 5 includes a separate machine 18 that receives bags B from the forming machine 10 and further stacks and/or wraps the bags B.

It is often desireable to fully package the stacks of bags SB in the wrapping W, and thus, the wrapping flaps WF must be "end-folded" onto the ends of the stack of bags SB. The width and/or length of the wrapping flaps WF can vary, and width and/or length of the wrapping flaps WF is often based on the width of the wrapping W and the shapes and/or size of the stack of bags SB. For instance, as the size (e.g., width) of the bags B increase, the width of the wrapping flaps WF (see distance D1) decreases. In another instance, if the number of bags B in the stack of bags SB increases or decreases, the width (see distance D1) of the wrapping flaps WF will decrease or increase, respectively. The applicants recognized that known forming machines cannot quickly adapt to and process stacks of bags SB having different dimensions. Accordingly, the applicants further recognized that is would be advantageous to develop systems capable of end-folding the wrapping W and/or wrapping flaps WF onto the stack of bags SB regardless of the width of the wrapping W and/or the shapes and/or size of the stack of bags SB. Thus, through research and development, the applicants developed the systems 5 of the present disclosure that can automatically adjust and process stacks of bags SB having different dimensions. Thus, the stacks of bags SB are fully packaged by the systems 5 described hereinbelow.

Figure 3:
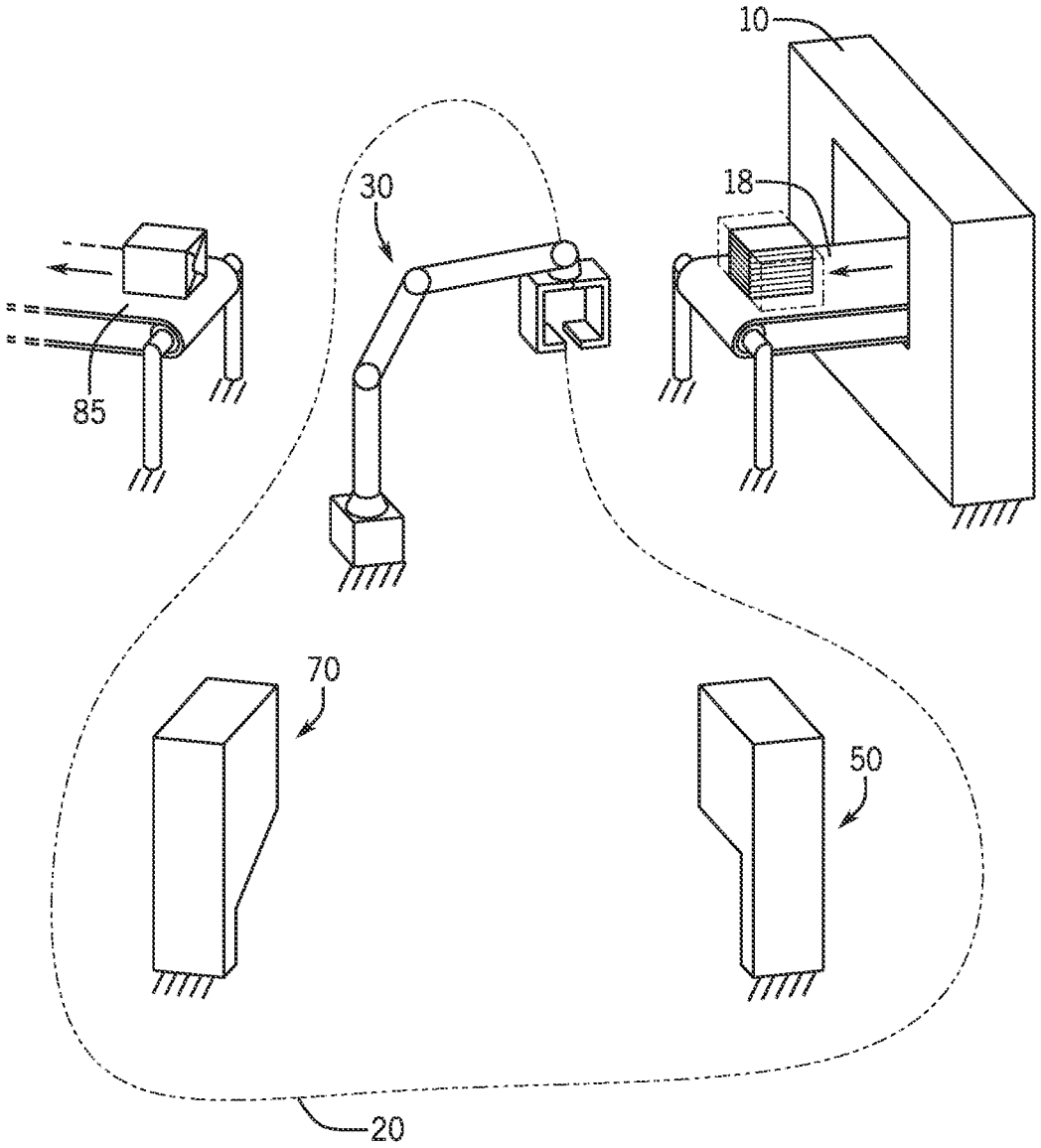
FIG. 3 is a schematic view of an example folding system of the present disclosure.
Figure 32C:
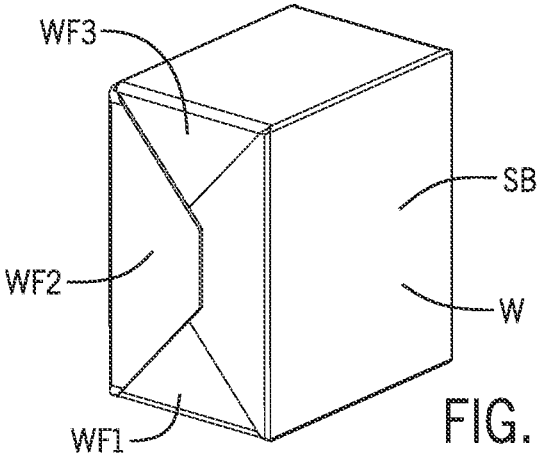
FIG. 32C is a perspective view of an example stack of bag with the wrapping flaps folded onto the ends of the stack bags.

FIG. 3 depicts a schematic diagram of an example folding machine 20. The folding machine 20 has a robotic arm 30 configured to engage and pickup a stack of bags SB that is partially packaged in the wrapping W. The robotic arm 30 is operable to move the partially packaged stack of bag SB to one or more folding stations 50, 70 where the robotic arm 30 moves the stack of bags SB relative to each folding station 50, 70 to thereby end-fold the wrapping flaps WF onto ends of the stack of bags SB to thereby fully package the stack of bags SB (described hereinbelow; see FIG. 32C for an example fully packaged stack of bags SB).

Figure 4:
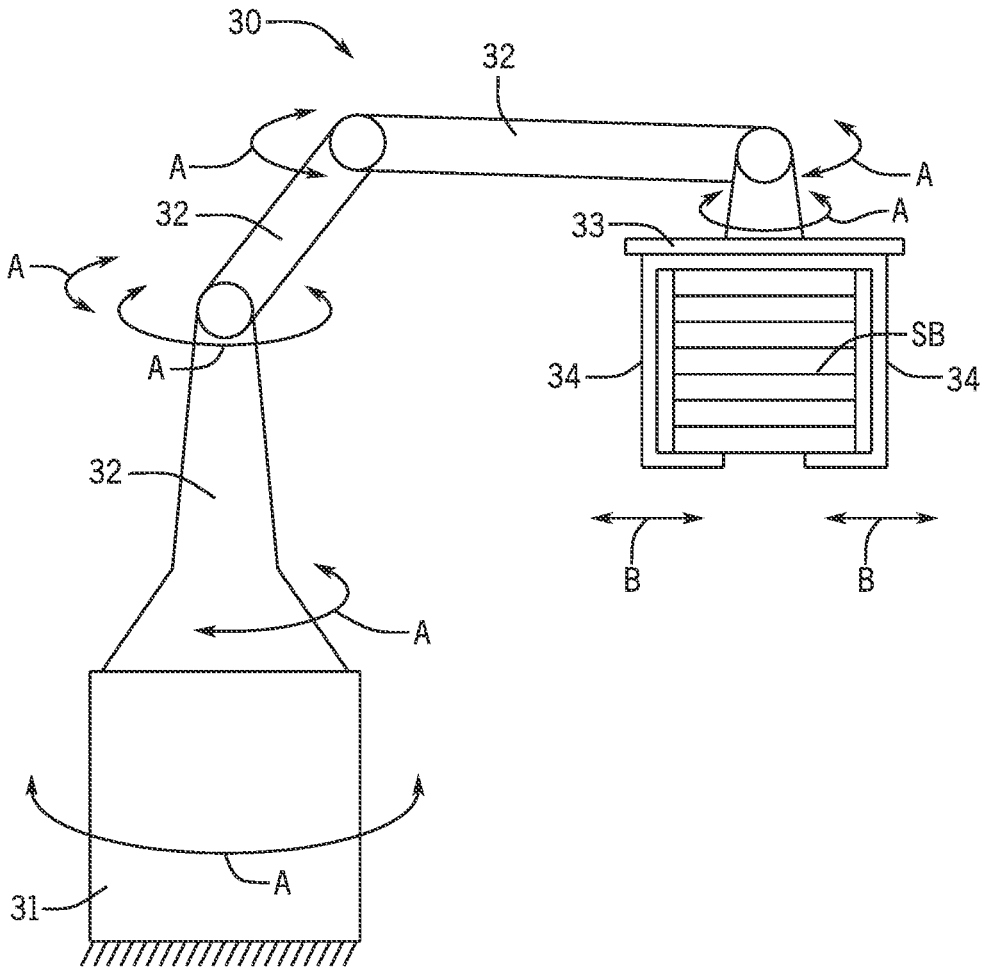
FIG. 4 is a side view of an example robotic arm.

FIG. 4 depicts an example robotic arm 30 in more detail. The robotic arm 30 has a rotating base 31, a plurality of arms 32, and a lift bracket 33. The arms 32 and the lift bracket 33 rotate and move relative to each other and the base 31 such that robotic arm 30 moves into various positions and orientations. Example movements of the base 31, the arms 32, and the lift bracket 33 are depicted by arrows A (FIG. 4). Note that a person of ordinary skill in the art will recognize that the robotic arm 30 may move in other directions that those directions depicted in FIG. 4. Examples of conventional robotic arm are manufactured by FANUC America Corporation. The applicant has also contemplated that the robotic arm 30 can be replaced with any other robot, machine, or component that is capable of picking and moving the stack of bags SB as described herein.

Figure 5:
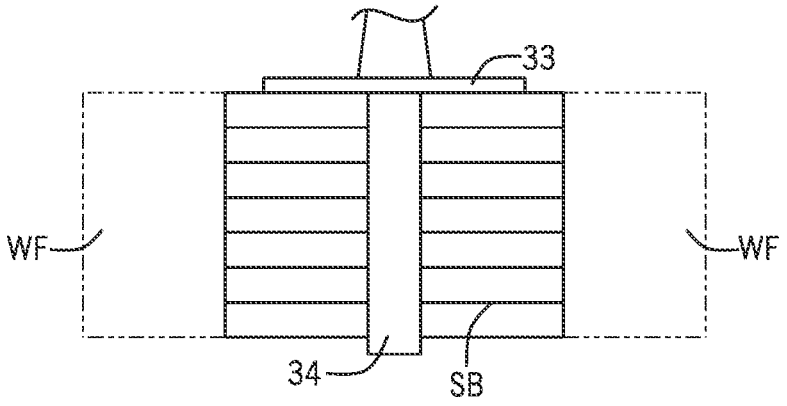
FIG. 5 is a side view of an example stack of bags clamped between legs of the robotic arm. Note that the wrapping is depicted in dashed lines.
Figure 23:
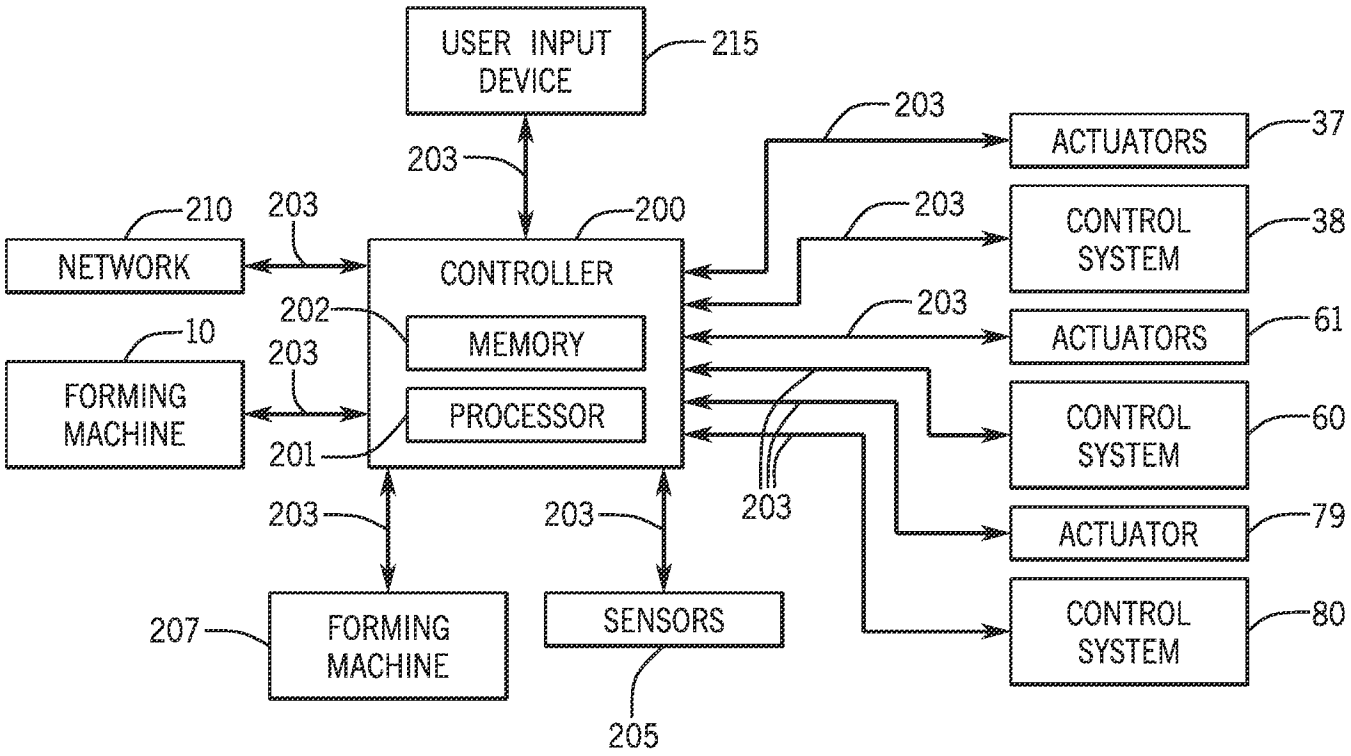
FIG. 23 is a schematic diagram of an example control system of the present disclosure.

The robotic arm 30 also includes clamping legs 34 that are movable relative to each other and along the lift bracket 33 (see arrows Bin FIG. 4) into different positions to thereby clamp onto the stack of bags SB. For example, the legs 34 are movable into and between an open position in which the stack of bags SB can be received into or removed from the space between the legs 34 and closed position in which the legs 34 engage (e.g., apply a compression force) the stack of bags SB. Note that FIGS. 4-5 depict the legs 34 in a closed position such that the stack of bags SB is securely clamped between the legs 34. In certain examples, one or more actuators 37 (FIG. 23) facilitate movement of the components of the robotic arm 30. The actuators 37 are coupled to a first control subsystem 38 (FIG. 23) that is in communication with a controller 200 (FIG. 23). The actuators 37 can be any suitable devices such as hydraulic pistons, servomotors, and/or devices with pistons and motors. The first control subsystem 38 may include an electrical control system, a hydraulic control system, or an electro-hydraulic control system for actuating of the actuator 37 and/or other components of the robotic arm 30.

Figure 6:
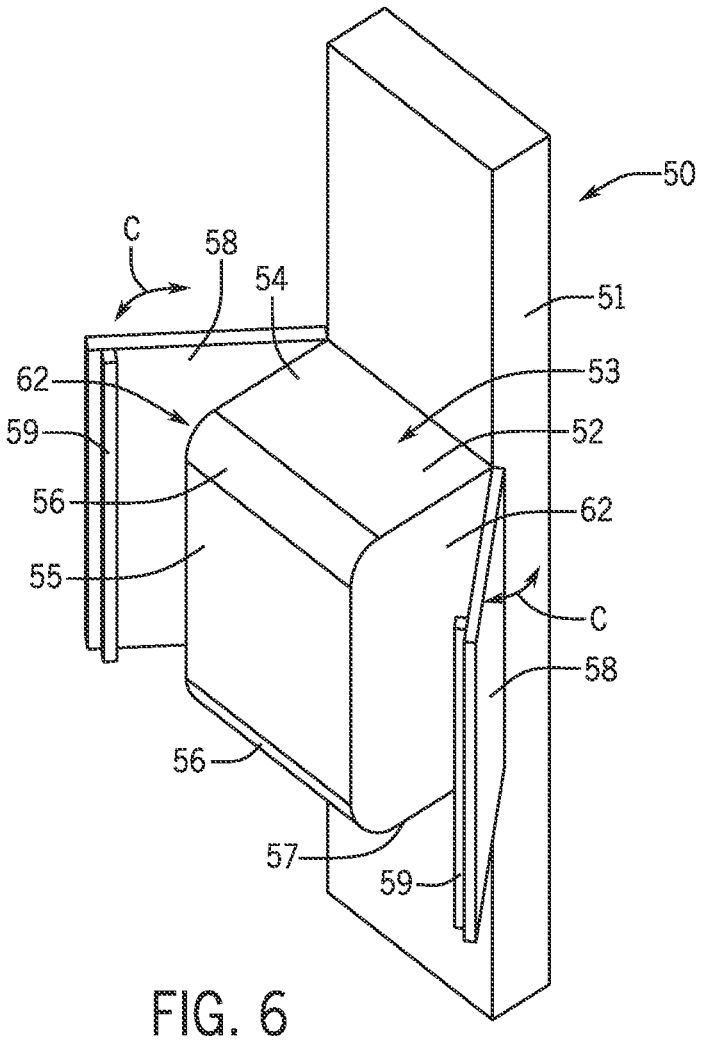
FIG. 6 is a perspective view of an example first folding station.

Referring now to FIG. 6, example first folding station 50 is depicted. The first folding station 50 includes a frame 51 and a bullnose 52 with a contact surface 53. The contact surface 53 comprises a plurality of sub-surfaces such as a first surface 54, a second surface 55 that extends transverse to the first surface 54, a third surface 57 that extends transverse to the second surface 55, and one or more curved surfaces 56.

The first folding station 50 also has a pair of opposing movable paddles 58 that are pivotally connected to the bullnose 52 and/or the frame 51. The paddles 58 pivot (see arrows C on FIG. 6) relative to the bullnose 52 into and between an open position (see FIGS. 6-7) and a closed position (see FIG. 11). Bumper members 59 attached to the paddles 58 are configured to contact the wrapping flaps WF and push the wrapping flaps WF against the side surfaces 62 of the bullnose 52 such that one or more creases can be formed in the wrapping W and/or wrapping flaps WF (described further hereinbelow).

Figure 11:
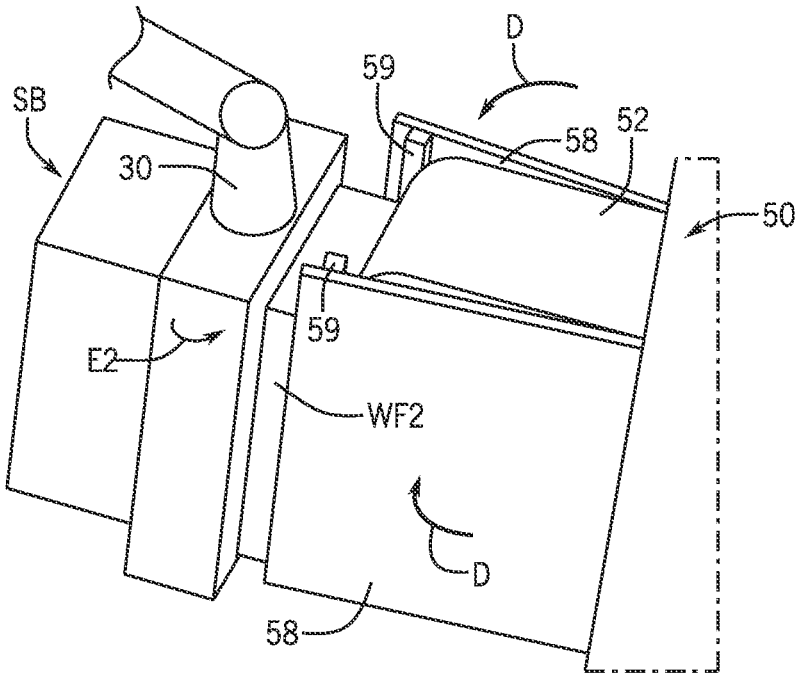

Actuators (not shown) move the paddles 58 into and between the open (FIGS. 6-7) and closed positions (FIG. 11). In certain examples, paddle actuators 61 (FIG. 23) move the bumper members 59 relative the paddles 58. The actuators and the paddle actuators 61 of the first folding station 50 are connected to a second control subsystem 60 (FIG. 23), and the second control subsystem 60 is in communication with the controller 200 (FIG. 23). The actuators and the paddle actuators 61 can be any suitable device such as hydraulic pistons, servomotors, and/or devices with pistons and motors. The second control subsystem 60 may include an electrical control system, a hydraulic control system, or an electro-hydraulic control system for actuating of the actuator 37 and/or other components of the first folding station 50.

Referring now to FIGS. 7-14, an example movement sequence of the robotic arm 30 relative to the first folding station 50 to thereby fold one or more wrapping flaps WF onto the exposed ends of the stack of bags SB is described hereinbelow. For clarity the wrapping flaps WF are labeled WF1-WF4 in FIGS. 7-14.

Figure 7:
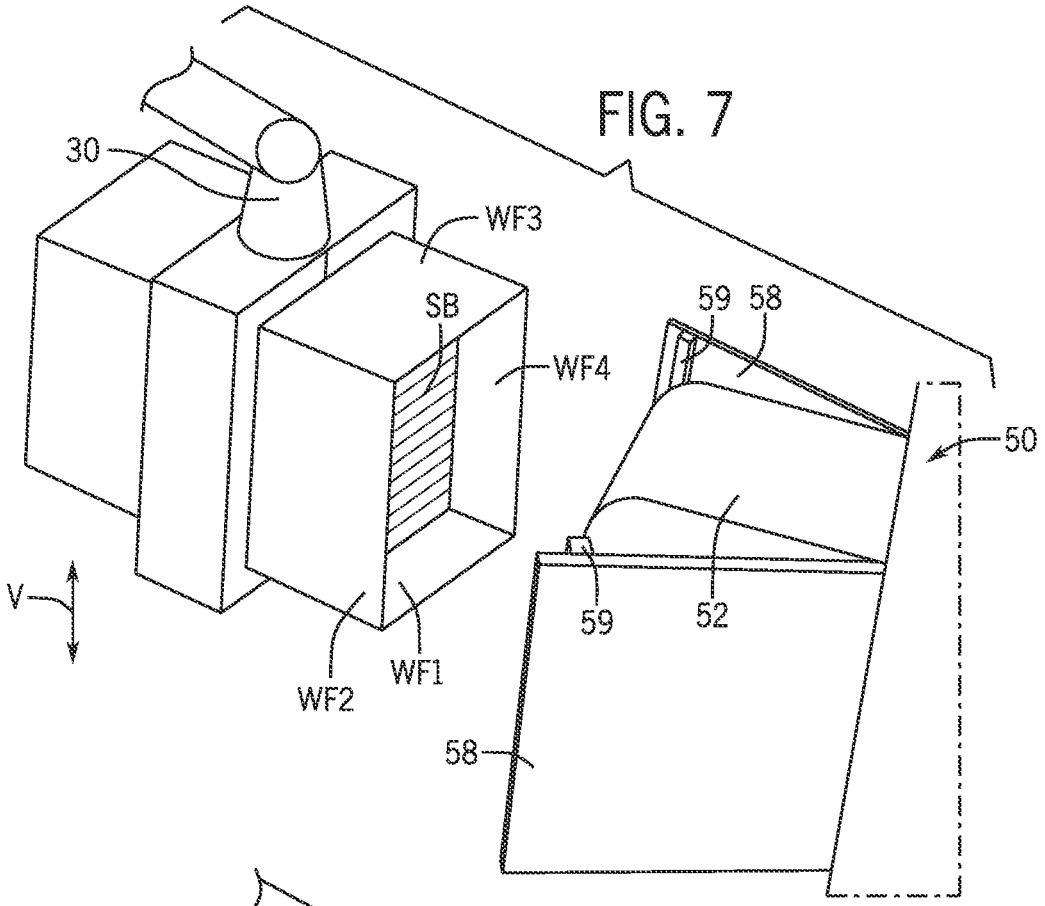
FIGS. 7-14 depict an example movement sequence of the robotic arm relative to the first folding station to thereby fold the wrapping onto ends of the stack of bags.

FIG. 7 depicts the stack of bag SB moved into a position relative to the bullnose 52. Next, the robotic arm 30 moves the stack of bags SB into a position in which the first wrapping flap WF1 is vertically (see vertical axis V) above the bullnose 52 and vertically upwardly angled relative to the upper surface of the bullnose 52 before moving the stack of bags SB into the position depicted in FIG. 8. Note that in FIG. 7 the paddles 58 are in the open position.

Figure 8:
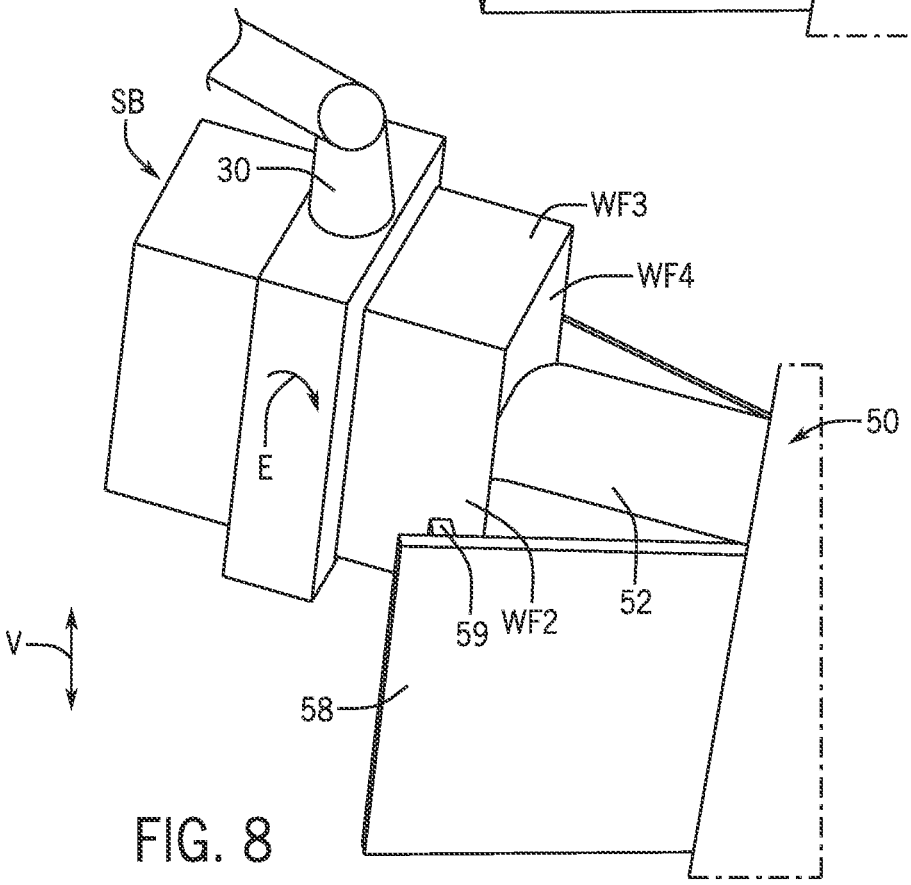
Figure 12:
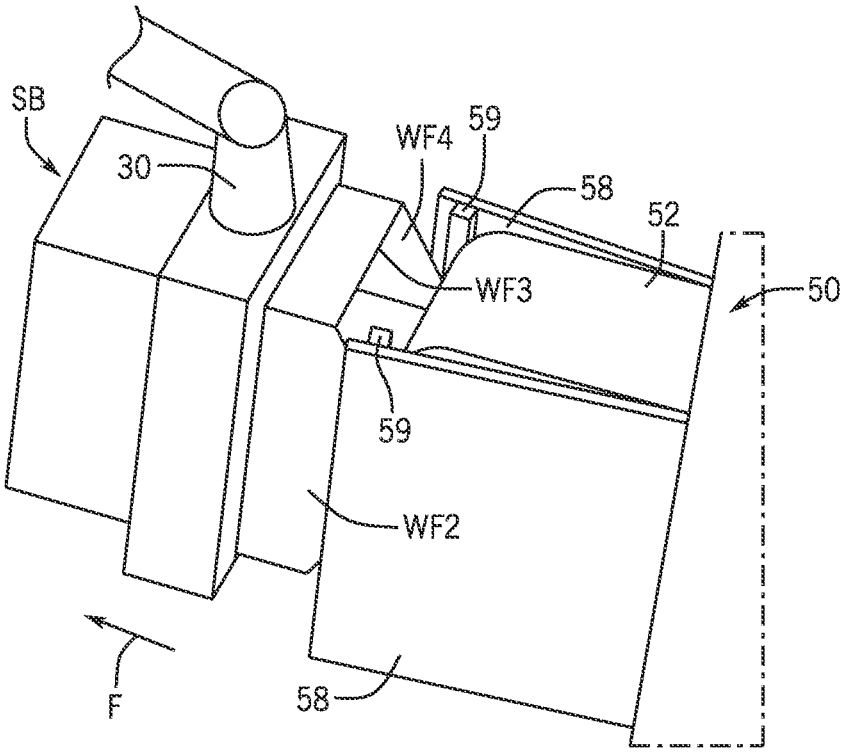
Figure 13:
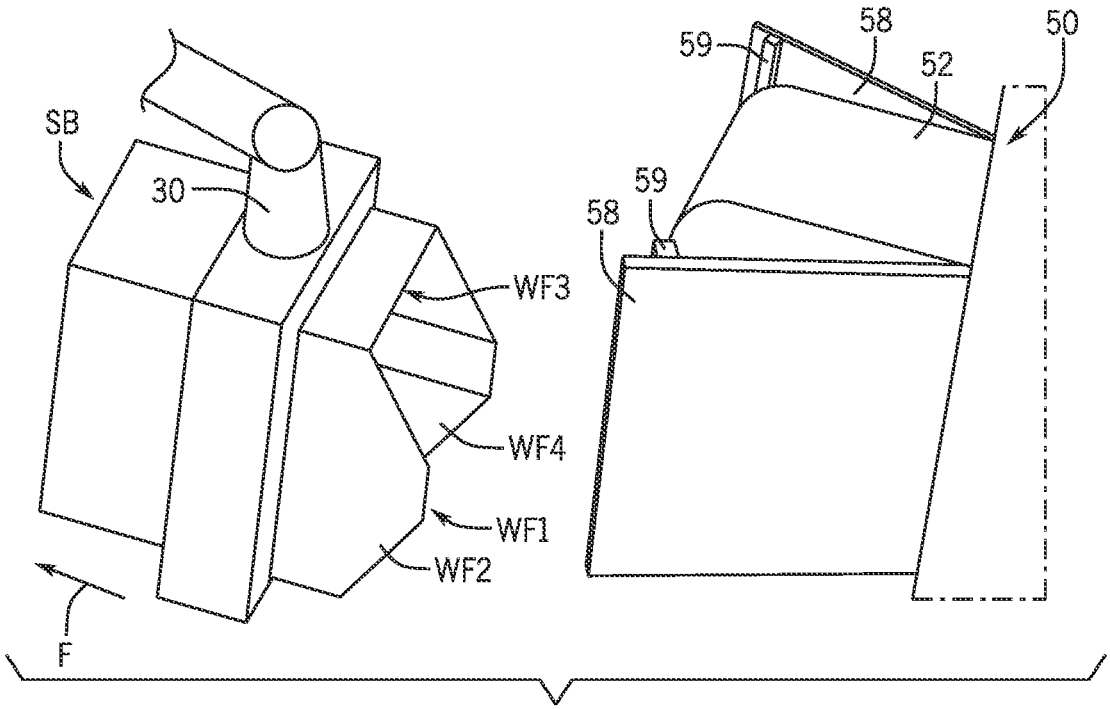

FIG. 8 depicts that the robotic arm 30 has moved the stack of bags SB vertically downwardly and in a rotational direction (see arrow E). As the robotic arm 30 moves the stack of bags SB into the position depicted in FIG. 8, the stack of bags SB is moved the along the contact surface 53 of the bullnose 52. Thus, the first wrapping flap WF1 is moved into contact with and slides along the contact surface 53 such that the first wrapping flap WF1 is folded against one of the uncovered or exposed sides of the stack of bags SB. Note that the second wrapping flap WF2 and the fourth wrapping flap WF4 are moved into a spaces defined between the side surfaces 62 of the bullnose 52 and the paddles 58. Once the wrapping flaps WF3, WF4 are located within these spaces, the paddles 58 are moved into closed positions (as depicted in FIGS. 11-12) such that the bumper members 59 press the wrapping flaps WF2, WF4 toward the side surfaces 62 of the bullnose 52.

Figure 9:
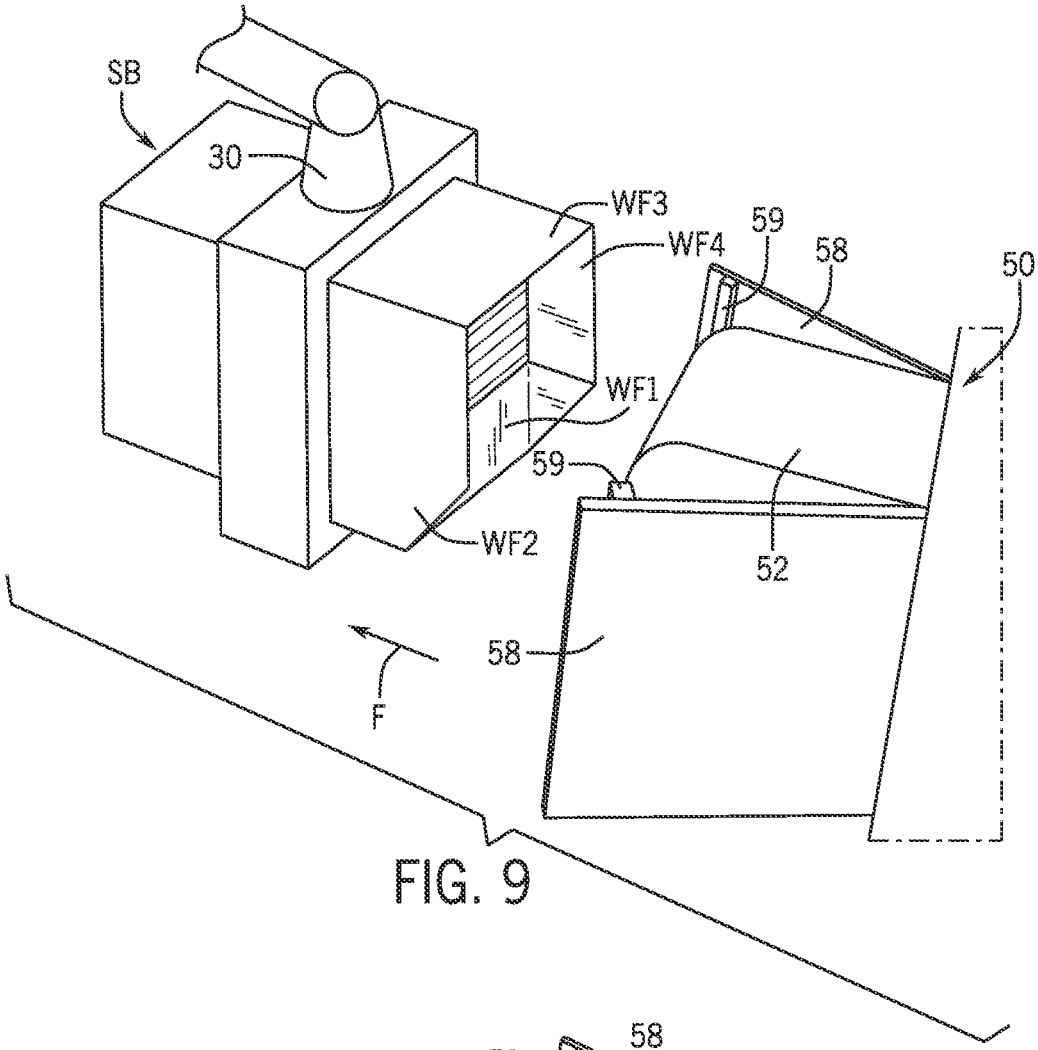

FIG. 9 depicts the stack of bags SB moved away from the bullnose 52 (see arrow F). As the stack of bags SB is moved away from the bullnose 52 (from the position depicted in FIG. 8 to the position depicted in FIG. 9) creases are formed in the wrapping (e.g., creases are formed between the first wrapping flap WF1 and the second wrapping flap WF2 and between the first wrapping flap WF1 and the fourth wrapping flap WF4) as the bumper members 59, which is pressing the second wrapping flap WF2 and the fourth wrapping flap WF4 into contact with the bullnose 52 (as noted above), slides along the wrapping W. After the creases are formed, the paddles 58 are moved into the open position, as depicted in FIG. 9.

Figure 10:
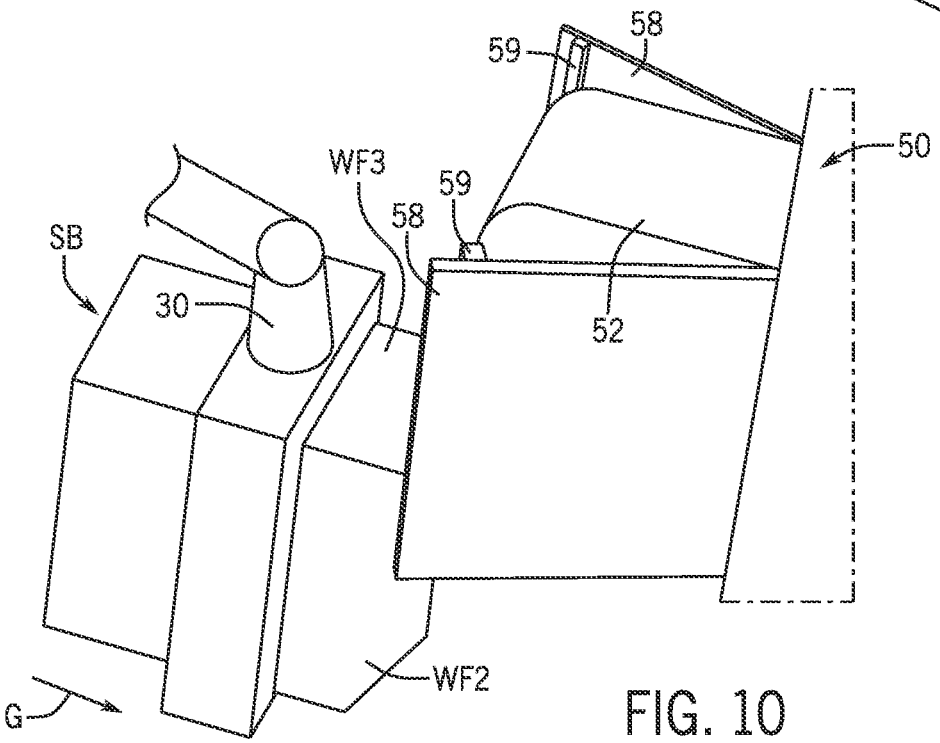

FIG. 10 depicts the stack of bags SB moved into a position in which the third wrapping flap WF3 is vertically below the bullnose 52. The third wrapping flap WF3 is vertically downwardly angled relative to the lower surface of the bullnose 52. The paddles 58 are in the open position.

FIG. 11 depicts that the robotic arm 30 has moved the stack of bags SB vertically upwardly and in a rotational direction (see arrow E2) from the position of the stack of bags SB depicted in FIG. 10. As the robotic arm 30 moves the stack of bags SB into the position depicted in FIG. 11, the stack of bags SB is moved along the contact surface 53 of the bullnose 52. Thus, the third wrapping flap WF3 is moved into contact with and slides along the contact surface 53 such that the third wrapping flap WF3 is folded against the uncovered or exposed side of the stack of bags SB. Note that the second wrapping flap WF2 and the fourth wrapping flap WF4 are again moved into the space defined between the side surfaces 62 of the bullnose 52 and the paddles 58. Once the wrapping flaps WF3, WF4 are located within these spaces, the paddles 58 are moved into the closed position (as depicted in FIG. 12) such that the bumper members 59 press the wrapping flaps WF2, WF4 toward the side surfaces 62 of the bullnose 52. Note that the paddles 58 of FIG. 11 depicted moving (see arrows D) from the open position (FIG. 10) to the closed position (FIG. 12).

FIG. 12 depicts the stack of bags SB moving away from the bullnose 52 (see arrow F). As the stack of bags SB is moved away from the bullnose 52 (from the position depicted in FIG. 11 to the depicted in FIG. 12) creases are formed in the wrapping W (e.g., creases are formed between the third wrapping flap WF3 and the second wrapping flap WF2 and between the third wrapping flap WF3 and the fourth wrapping flap WF4) as described above. After the creases are formed, the paddles 58 are moved into the open position (see FIG. 13). Accordingly, the first wrapping flap WF1 and the third wrapping flap WF3 are folded against the uncovered or exposed side of the stack of bags SB (see also FIG. 17)

Figure 14:
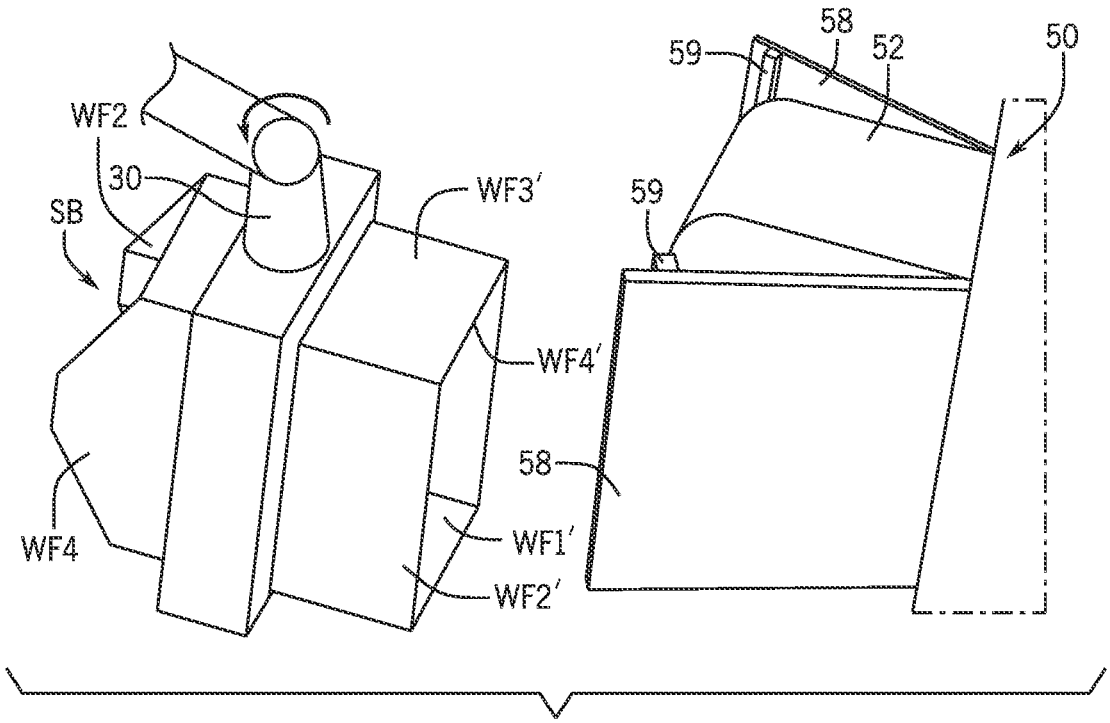

FIG. 14 depicts the stack of bags SB rotated 180 degrees by the robotic arm 30 into a position in which the wrapping flaps WF1'-WF4' extending from the opposing uncovered or exposed side of the stack of bags SB face the bullnose 52. Accordingly, these wrapping flaps WF1'-WF4' are processed and/or folded the same manner as the wrapping flaps WF1-WF4 noted above with respect to FIGS. 7-13. A person of ordinary skill in the at will recognize that the order of the processes and steps noted above with respect to FIGS. 7-13 may be changed based on the specific application of the system 5.

Referring back to FIG. 3, after two of the four wrapping flaps WF on each side of the uncovered or exposed sides of the stack of bags SB are folded (as described above with respect to FIGS. 7-14), the robotic arm 30 moves the stack of bags SB to the second folding station 70 where the remaining unfolded wrapping flaps WF (e.g., the second wrapping flaps WF2, WF2' and the fourth wrapping flaps WF4, WF4') are folded onto the stack of bags SB as described below.

Figure 16:
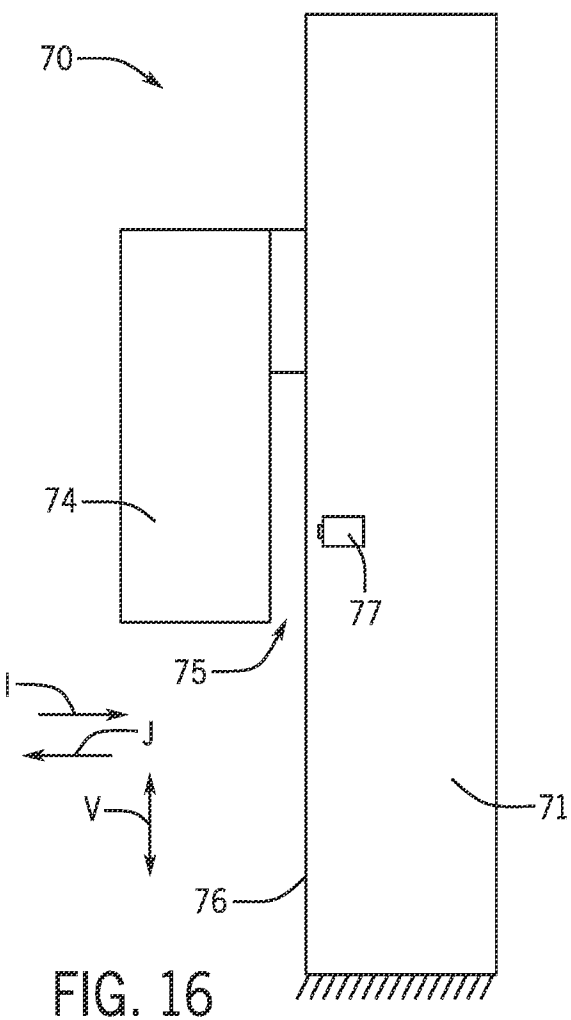
FIG. 16 is a side view of the second folding station of FIG. 15.
Figure 15:
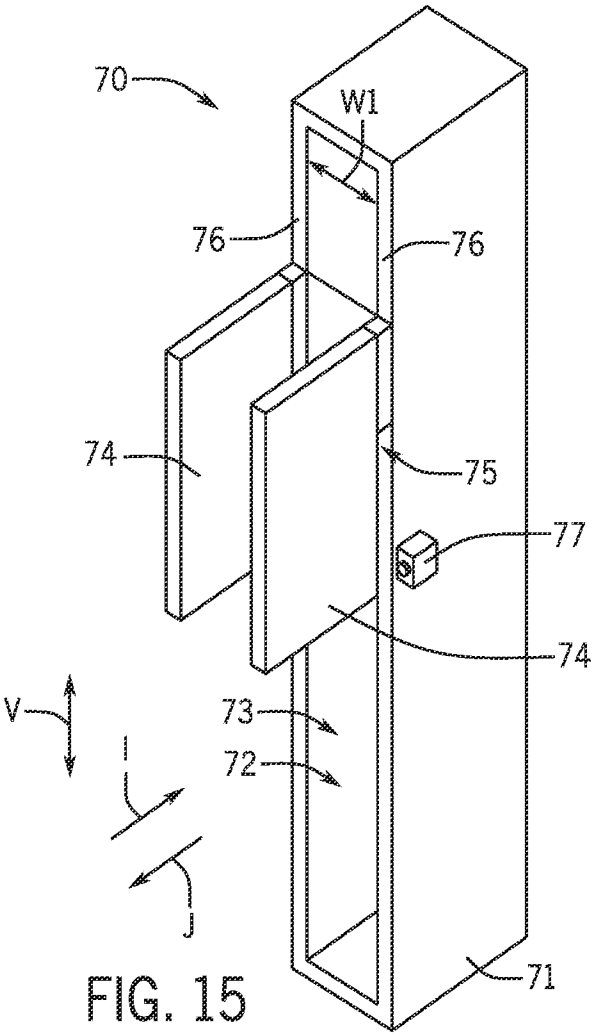
FIG. 15 is a perspective view of example second folding station.

FIGS. 15-16 depict the second folding station 70 in greater detail. The second folding station 70 has a frame 71 with vertically extending support members 76 that define an opening 72 and a cavity 73 into which the stack of bag SB can be received. Side arms 74 are attached to the support member 76, and the side arms 74 extend parallel to each other and in a first direction (see arrow J) away from the support members 76. Channels 75 are defined between the side arms 74 and the support members 76. The channels 75 are configured to receive the unfolded wrapping flaps WF. In certain examples, actuators (not shown) move the support members 76 relative to each other to thereby vary the width (see W1) of the opening 72 and the channel 75. An adhesive applicator 77 is coupled to each vertical member 76, and the adhesive applicator 77 is configured to apply adhesive to one or more of the wrapping flaps WF. In certain examples, the adhesive applicators 77 vertically move along the support members 76. Actuators 79 (FIG. 23) may be connected to the adhesive applicators 77 and/or the vertical members 76, and the actuators 79 are connected to a third control subsystem 80 (FIG. 23) that operates the actuators 79, and the third control subsystem 80 (FIG. 23) is controlled by the controller 200. The actuators 79 can be any suitable device such as hydraulic pistons, servomotors, and/or devices with pistons and motors. The third control subsystem 60 may include an electrical control system, a hydraulic control system, or an electro-hydraulic control system for actuating of the actuator 79.

Referring now to FIGS. 17-22, an example movement sequence of the robotic arm 30 relative to the second folding station 70 to thereby fold the remaining, unfolded wrapping flaps WF onto the uncovered or exposed sides of the stack of bags SB is described hereinbelow. For example, the second wrapping flap WF2 and the fourth wrapping flap WF4 at each of the uncovered or exposed sides of the stack of bags SB are folded on the ends of the stack of bags SB at the second folding station 70.

Figure 17:
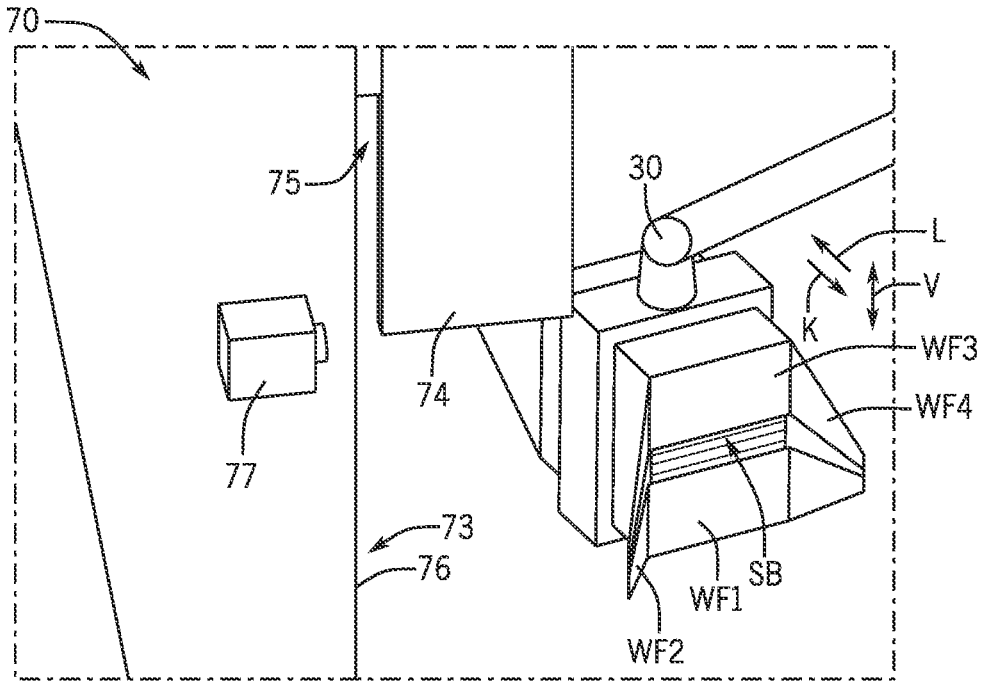
FIGS. 17-22 depict an example movement sequence the robotic arm relative to the second folding station to thereby fold the wrapping onto the ends of the stack of bags.

FIG. 17 depicts the stack of bags SB adjacent to the vertical members 76 and vertically below the side arms 74. Note that the second wrapping flap WF2 and the fourth wrapping flap WF4 on the uncovered or exposed side of the stack of bags SB extend in a third direction (see arrow K). Also, note that the second wrapping flap WF2' and the fourth wrapping flap WF4' on the opposite uncovered or exposed side of the stack of bags SB are hidden; however, these wrapping flaps WF2', WF4' extend in a fourth direction (see arrow L) opposite the third direction (arrow K).

Figure 18:
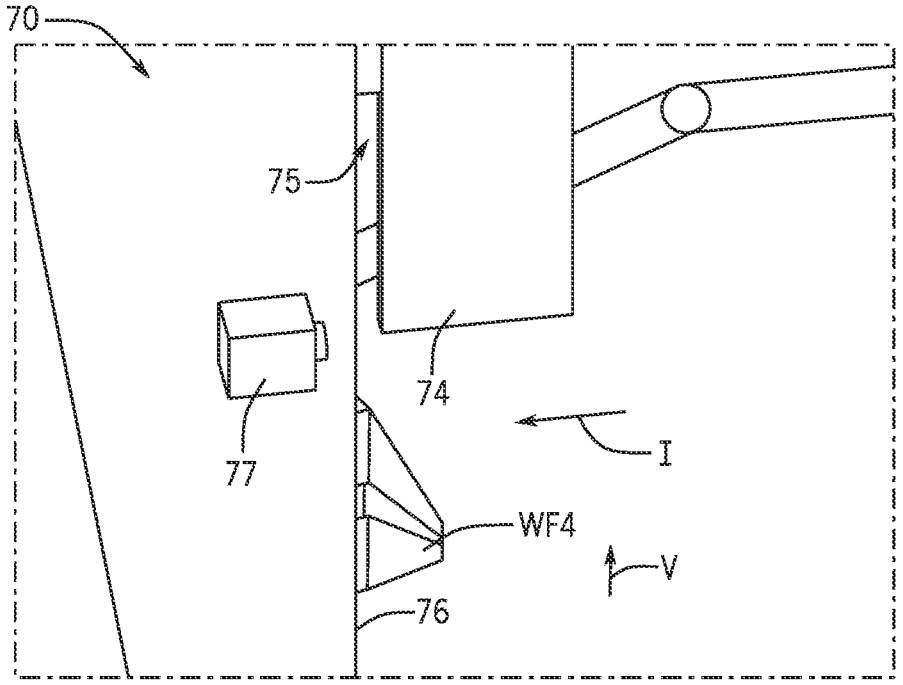

FIG. 18 depicts the stack of bags SB moved into the cavity 73 (FIG. 15) after the robotic arm 30 moves the stack of bags SB in the second direction (see arrow I) from the position depicted in FIG. 17. As the stack of bags SB is moved from the position depicted in FIG. 17 to the position depicted in FIG. 18, the leading, unfolded wrapping flap, such as the second wrapping flap WF2 as depicted in FIG. 17, contacts and is folded onto the stack of bags SB by the vertical member 76. Note that the leading, unfolded wrapping flap on the opposite uncovered or exposed side of the stack of bags SB, such as the fourth wrapping flap WF4', is also folded onto the stack of the bags SB by the opposite vertical member 76 (not shown) when the stack of bags SB is moved into the cavity 73. Note that the trailing wrapping flaps, such as the wrapping fourth flap WF4 depicted in FIG. 17 (and the trailing wrapping flap on the opposite end of the stack of bags SB), is now positioned adjacent to the vertical member 76 and vertically below the side arms 74. Also note that while the below description of further steps are described with reference to the wrapping flaps on one side of the stack of bags SB, the wrapping flaps on the opposing side of the stack of bags SB will be also be processed and/or folded in a similar manner and simultaneously.

Figure 19:
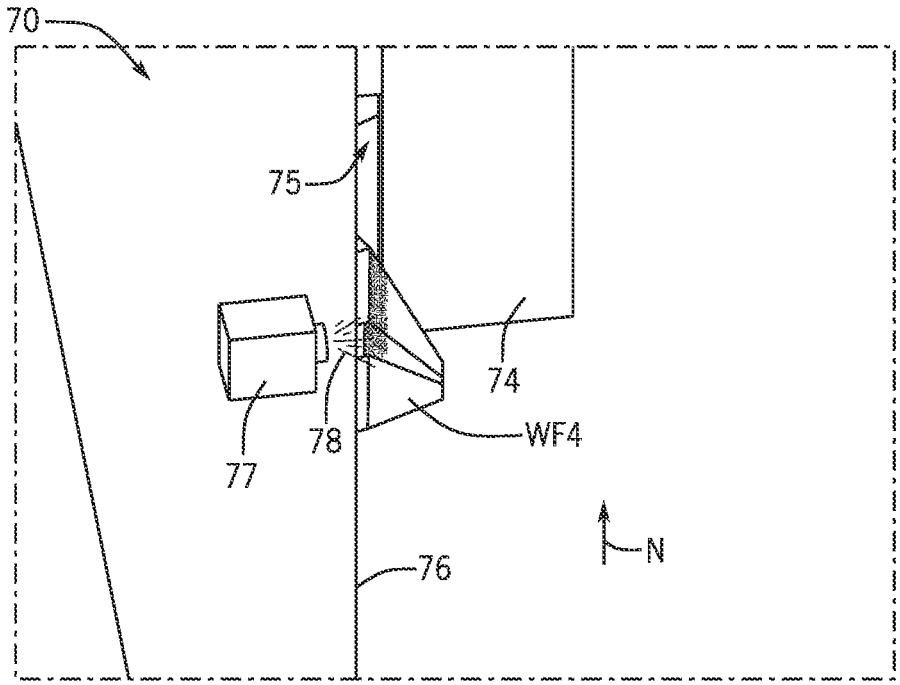
Figure 20:
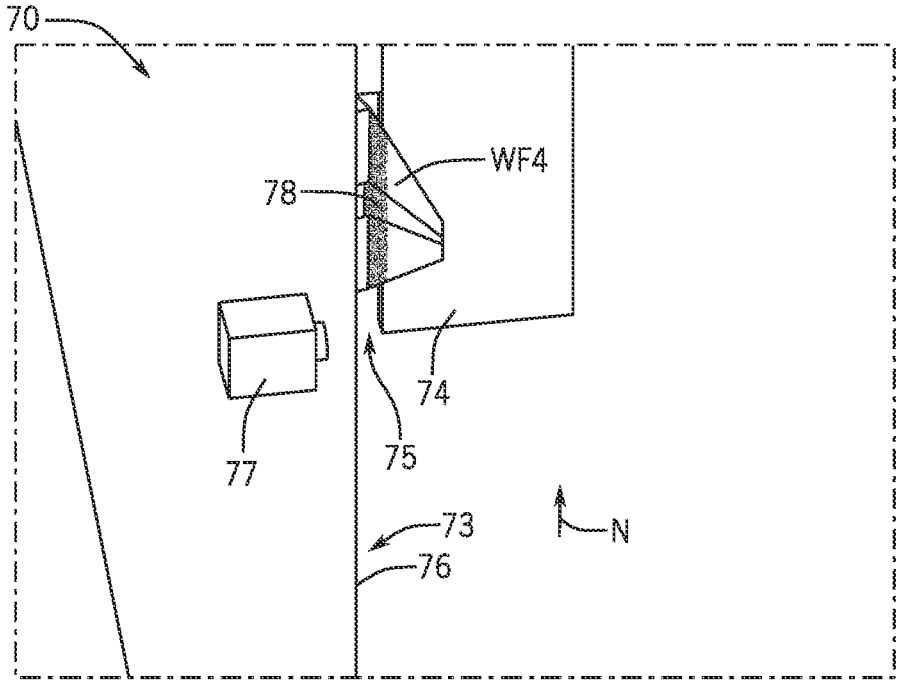

FIG. 19 depicts the robotic arm 30 vertically upwardly moving (see arrow N) the stack of bags SB and the adhesive applicator 77 applying (e.g., spraying) adhesive onto the trailing fourth wrapping flap WF4 (note the applied adhesive is depicted in shaded area 78 on FIGS. 19-20). The robotic arm 30 continues to vertically upwardly move the stack of bags SB such that the fourth wrapping flap WF4 is moved into the channels 75 defined between the side arms 74 and the vertical members 76. FIG. 20 depicts the fourth wrapping flap WF4 in the channel 75.

Figure 21:
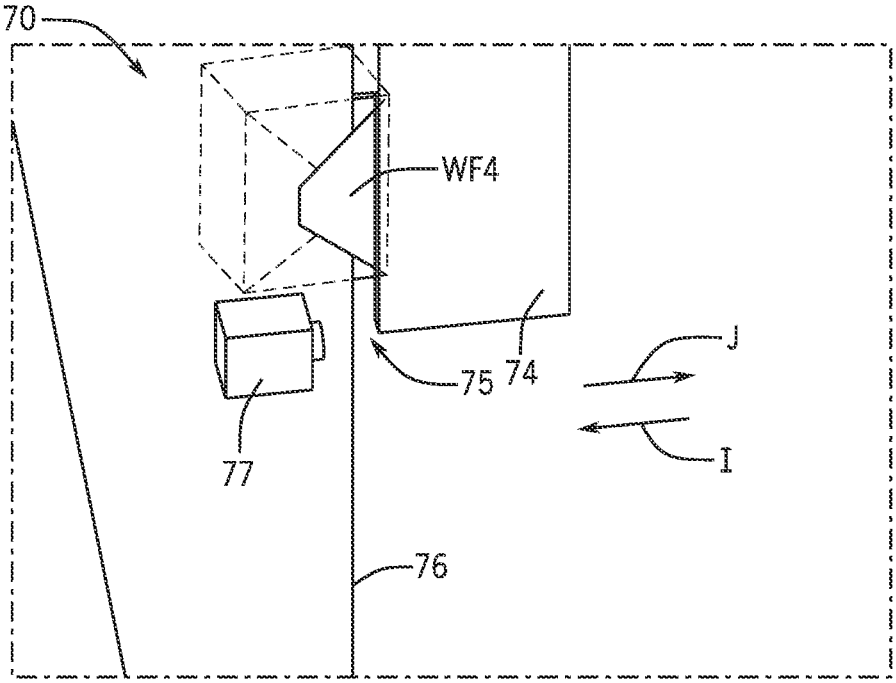
Figure 22:
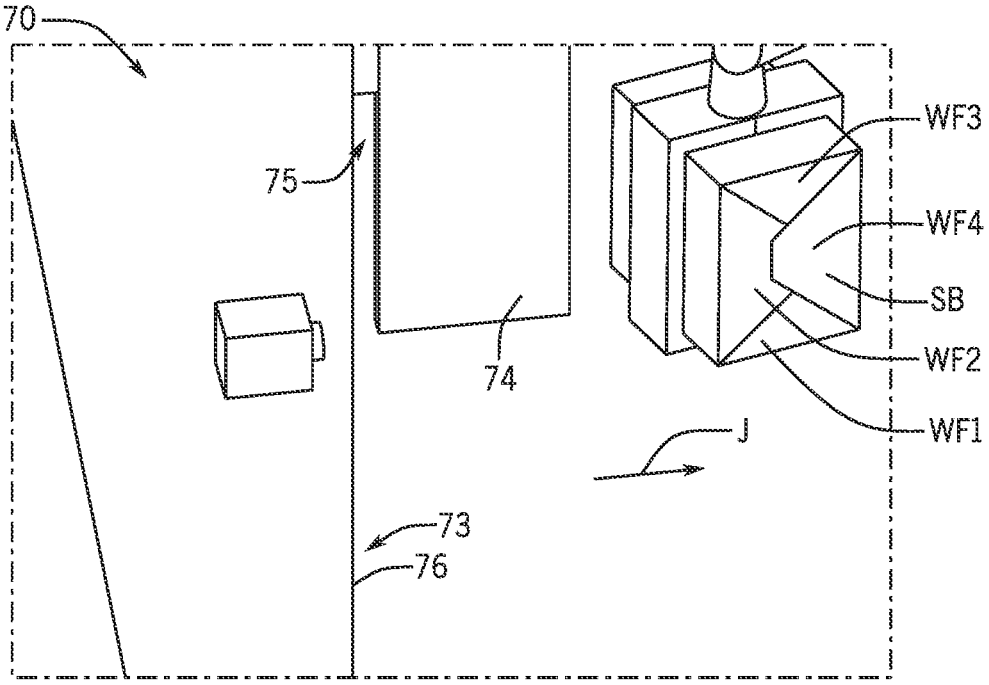

FIG. 21 depicts the robotic arm 30 moving the stack of bags SB in the first direction (see arrow J) out of the cavity 73 such that the fourth wrapping flap WF4 contacts the side arm 74 and that the fourth wrapping flap WF4 is folded onto the stack of bags SB and the other already folded wrapping flaps WF1-WF3 (depicted in dashed lines). The adhesive on the fourth wrapping flap WF4 adheres the fourth wrapping flap WF4 to the other wrapping flaps WF1-WF3 such that the wrapping W is end folded onto the stack of bags SB and the stack of bags SB is fully packaged within the wrapping W (see FIG. 22).

After the stack of bags SB is fully packaged, the robotic arm 30 moves the wrapped stack of bags SB to a conveyor 85 (FIG. 3) and releases the stack of bags SB. Accordingly, the conveyor 85, conveys the stack of bags SB to a downstream station (not shown), such as a shipping station or a labeling station. In another example, the robotic arm 30 stacks multiple wrapped stacks of bags SB on top of transport structure, such as a pallet or a dolly, for further processing and/or shipping.

As noted above, the folding machine 20 is configured to automatically adjust to accommodate stack of bags SB having different sizes and/or shapes. That is, components of the robotic arm 30, the first folding station 50, and/or the second folding station 70 are movable into different positions as noted above such the folding machine 20 can fully package the stack of bags SB in the wrapping W regardless of the size and/or shape of the stack of bags SB. The controller 200 controls movement of the components of the folding machine 20.

Referring to FIG. 23, an example control system 190 with the controller 200 of the folding machine 20 (FIG. 1) is depicted. The controller 200 has a processor 201 and a memory 202, and the controller 200 is connected to various components of the folding machine 20 and/or the forming machine 10 noted above via wired or wireless connection links 203. For example, the controller 200 is connected to the actuators 37 and/or the first control subsystem 38 of the robotic arm 30, the actuators 61 and/or the second control subsystem 60 of the first folding station 50, and the actuators 79 and/or the third control subsystem 80 of the second folding station 70. Note that in certain examples, the control subsystems 38, 60, 80 can include additional controllers for controlling the components of the system 5. The controller 200 can also be connected to sensors 205 that sense the location or position of the stack of bags SB or the wrapping flaps WF. Additional sensors 205 may be configured to sense the size and/or the shape of the stack of bags SB. The sensors 205 may be any suitable type, such as photo sensors, light sensors, and sonar sensors, that are configured to sense the stack of bags SB and/or the wrapping flaps WF. The controller 200 may be connected to a user input device 207 that is configured to receive input data from an operator. The controller 200 may also receive feedback data from different components of the forming machine 10. The controller 200 may also receive data from a network or internet 210. The data received by the controller 200 may correspond to the size and/or shape of the bags B and/or the stack of bags SB dispensed from the forming machine.

The controller 200 may include one or more programs or algorithms (stored on the memory 202), and the controller 200 may compare or processes the data, such as data received from the sensors 205, the user input device 207, the forming machine 10, and/or the like, with the programs or algorithms stored on the memory 202 to thereby efficiently and accurately package the stacks of bags SB in the wrapping W. In certain examples, the controller 200 and the memory 202 stores programs from each shape and/or size of the bags B and/or stack of bags SB, and each program includes data (such as a list of movement steps, movement distance of the robotic arm toward the bullnose, look-up tables, etc.) for completely packaging the stack of bags SB in the wrapping W.

Figure 24:
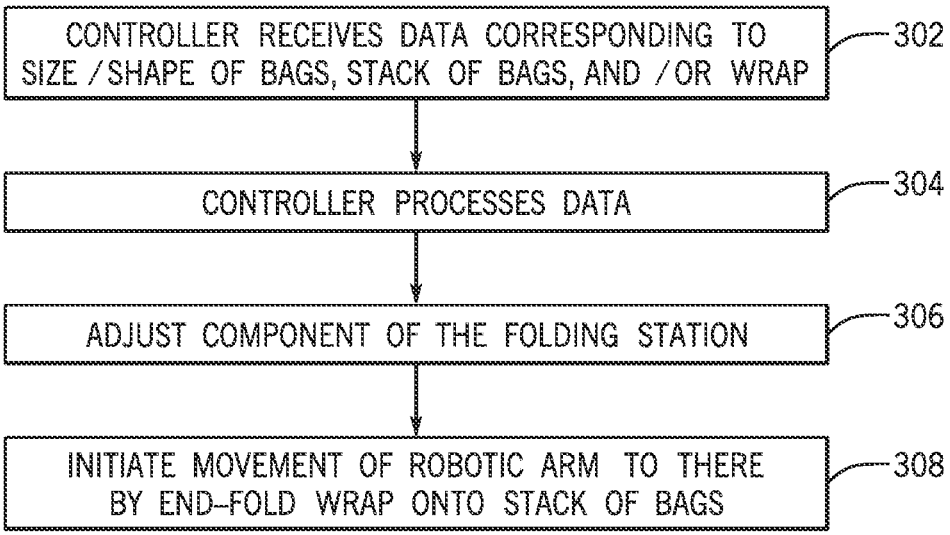
FIG. 24 illustrates an example operational method of the present disclosure.

Referring now to FIG. 24, an example method for controlling operation of the folding machine 20 (FIG. 3) is depicted. As shown at 302, the method begins with controller 200 receiving data corresponding to the size of the bags B, the expected dimensions of stack of bags SB, and/or the wrapping W. The controller 200 processes the data to determine how to adjust one or both of the folding stations 50, 70 to end-fold the wrapping W onto the stack of bags SB, at box 304. At box 306, the controller 200 controls the various components (such as actuators 61, 79 and control subsystems 60, 80) to thereby move components of the folding stations 50, 70 such that the folding stations 50, 70 can accommodate the size and shape of the stack of bags SB. For example, the bumper members 59 may be extended or retracted and/or the vertical members 76 may be moved toward or away from each other to vary the width of the cavity 73 (see W1 on FIG. 15). At box 308, the controller 200 controls movement of the robotic arm 30 based on programs and/or look-up tables stored onto the memory 202 to thereby end-fold the wrapping W onto the stack of bags SB. After the packaged stack of bag SB is released by the robotic arm 30, the method returns to box 302 and the method returns to box 302 to process another subsequent stack of bags SB.

FIGS. 25-31F depict another, second exemplary folding machine 20 for wrapping stacks of bags SB. Specifically, FIGS. 25-28 depict various view of the folding machine 20. The folding machine 20 includes an upstream end 401 and an opposite downstream end 402. The folding machine 20 generally extends longitudinally (see longitudinal axis L) between the upstream end 401 and the downstream end 402, laterally (see lateral axis T) between a front and a rear, and vertically (see vertical axis V) between a top and a bottom. A general description of the folding machine 20 is provided below with reference to FIGS. 25-28, followed by more detailed descriptions and operational details of the stations and/or components with reference to FIGS. 29A-31C.

Referring to FIGS. 25-28, a first conveyor 405 provides small stacks of bags SSB (e.g., 25 count stacks of bags) to the folding machine 20. Specifically, the first conveyor 405 conveys the small stack of bags SSB to a stacking station 420 of the machine 20 in which the small stacks of bags SSB are combined into a stack of bags SB (e.g., 200 or 300 count stacks of bags). The stack of bags SB is then pushed downstream out of the stacking station 420 and into a wrapping station 440. The wrapping station 440 is configured to at least partially wrap the stack of bags SB in the wrapping W. After the wrapping station 440 partially wraps the stack of bags SB (see FIG. 32B), the partially wrapped stack of bags SB is pushed downstream into a first folding station 450 in which one or more wrapping flaps WF1-WF4 of the wrapping W are folded onto the uncovered or exposed sides of the stack of bags SB. The stack of bags SB with one or more wrapping flaps WF1-WF4 folded onto the uncovered or exposed sides of the stack of bags SB is conveyed downstream to a second folding station 470 in which the remaining, unfolded wrapping flaps WF1-WF4 are folded onto the uncovered or exposed sides of the stack of bags SB. Accordingly, the fully packaged stack of bags SB (see FIG. 32C) is conveyed out of the second folding station 470 to an outlet chute 410 that conveys the packaged stack of bags SB to another station (not shown) such as a shipping station or pallet station.

Figure 29A:
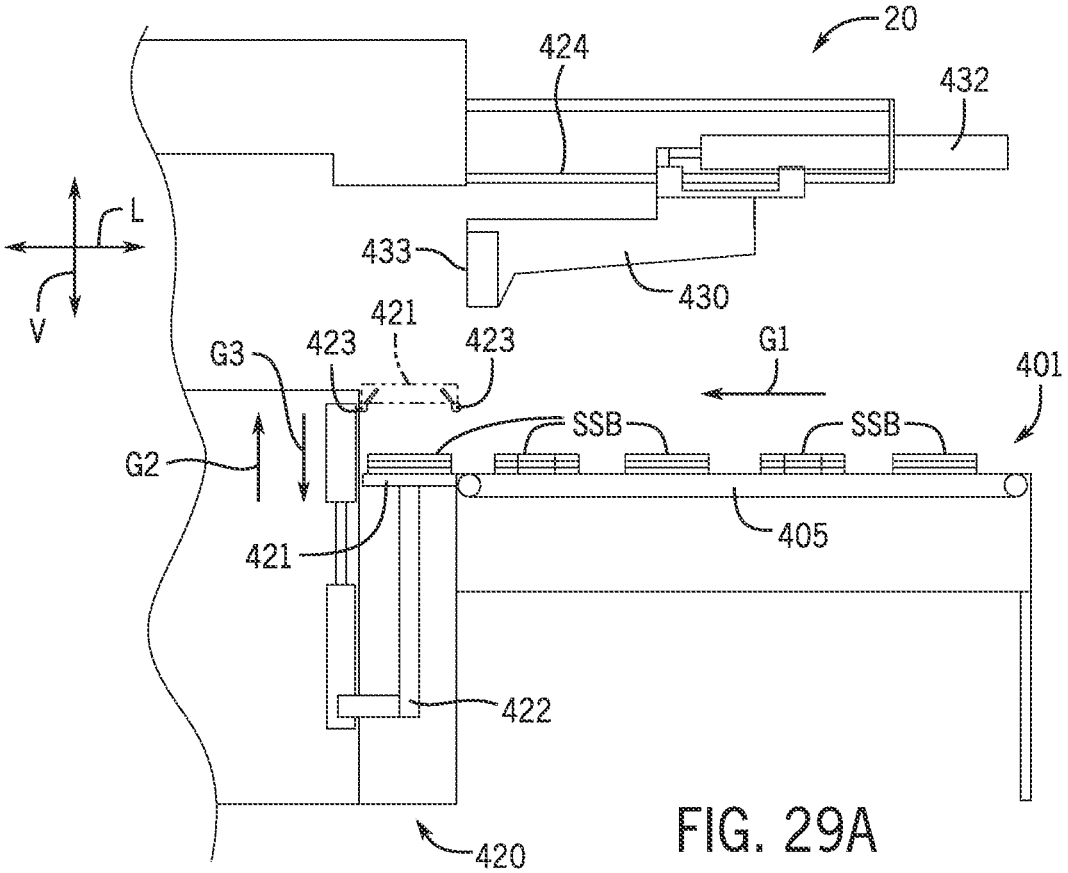
FIGS. 29A-29E are schematic views of upstream sections of the second exemplary folding machine depicted in FIG. 25-28 including a first conveyor, a stacking station, a pusher, and a wrapping station.
Figure 29B:
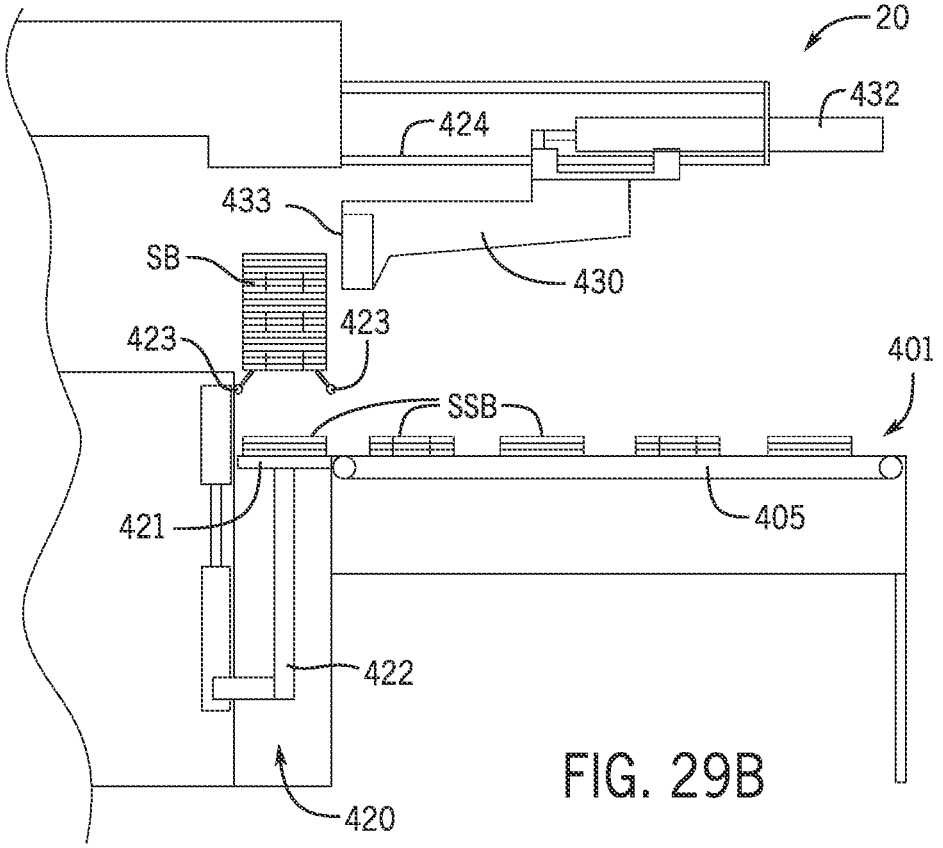

Referring now to FIGS. 29A-29B depict the system 5 collecting multiple small stack of bags SSB and forming a stack of bags SB that is later wrapped with the wrapping W. FIG. 29A depicts several small stacks of bags SB on the first conveyor 405, and the first conveyor 405 conveys these small stacks of bags SB toward the stacking station 420 (see arrow G1). The first conveyor 405 conveys the small stacks of bags SB onto a plate 421 that is configured to vertically lift the small stacks of bags SB (see arrow G2). The plate 421 is moved by an actuator 422 (e.g., hydraulically actuated piston) between a lowered position (depicted in solid lines on FIG. 29A) and a raised position (depicted in dashed lines on FIG. 29A). In operation, when a small stacks of bags SB is conveyed onto the plate 421, the actuator 422 vertically moves the plate 421 from the lowered position to the raised position. As in the plate 421 approaches the raised position, the small stacks of bags SSB contact and move arms 423 away from each other. Once the small stacks of bags SSB vertically clears the arms 423, the arms 423 move (e.g., pivot) back toward each other (note that the arms 423 are pivotally biased into the position depicted in FIG. 29A). Accordingly, the arms 423 support the small stacks of bags SSB thereon and the plate 421 is lowered by gravity or the actuator 422 into the lowered position (see arrow G3). Thus, subsequent small stack of bags SSB can be lifted by the plate 421. As each subsequent small stack of bags SSB is lifted by the plate 421, the multiple small stacks of bags SSB held by the arms 409 are vertically upwardly pushed by the subsequent small stack of bags SSB such that a stack of bags SB is formed and vertically held by the arms 423. Note that the arms 423 could be pivoted by an actuator (not shown) as each small stack of bags SSB is lifted. Also note the orientation of small stacks of bags SSB on the conveyor 405 can vary, and in one specific example, the small stacks of bags SB are received onto the first conveyor 405 are in alternating orientations (e.g., the handles of the bags in each small stack of bag SSB are alternately oriented toward the front and the rear of the folding machine 20). Accordingly, in this example, the stack of bags SB formed in the stacking station 420 have layers of alternating orientated small stacks of bags SSB (see FIG. 32A for an example stack of bags).

Figure 29C:
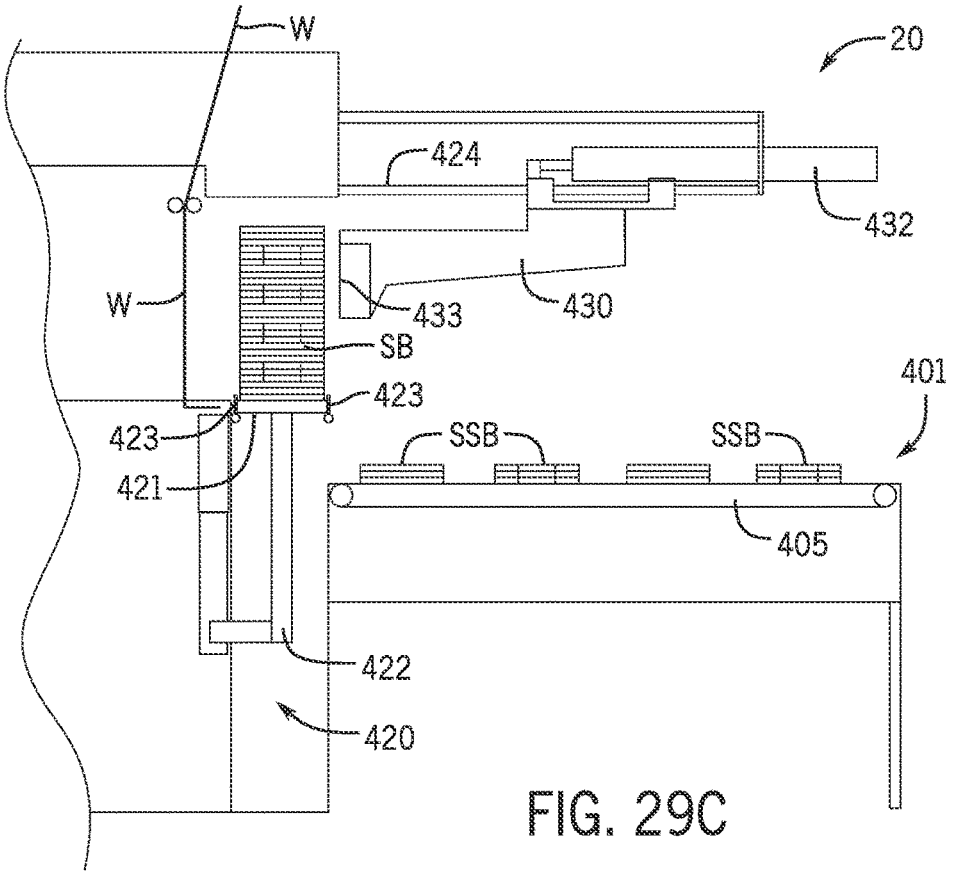
Figure 29D:
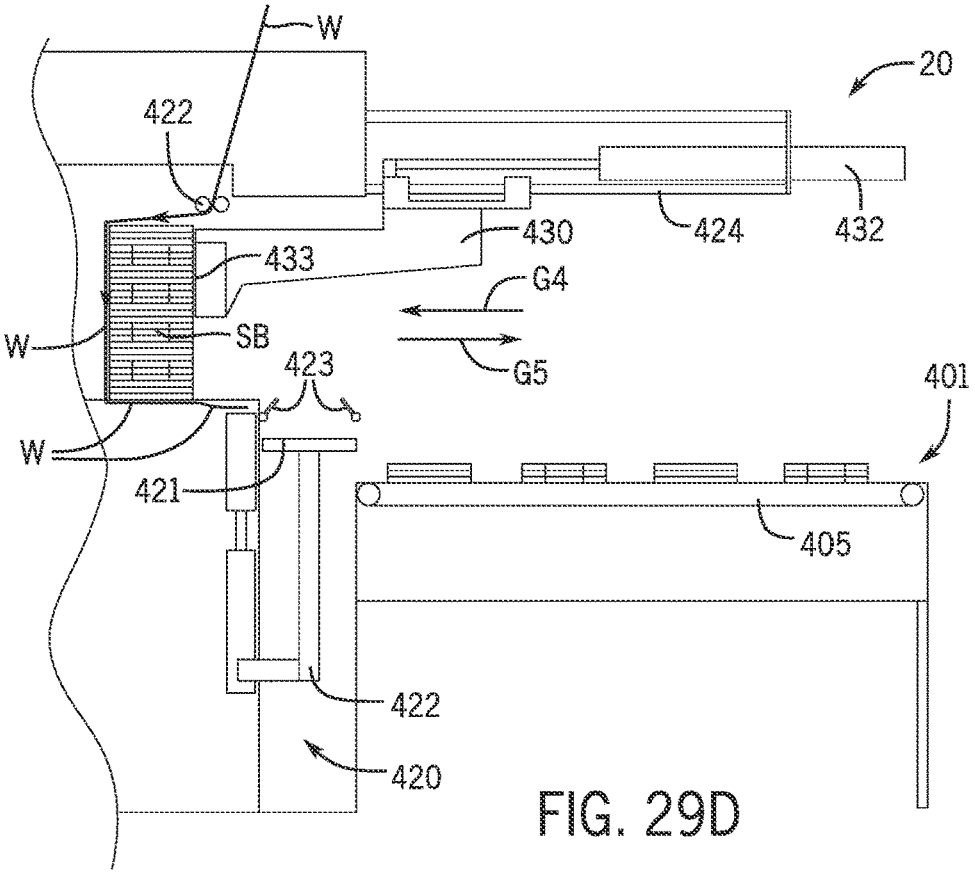
Figure 29E:
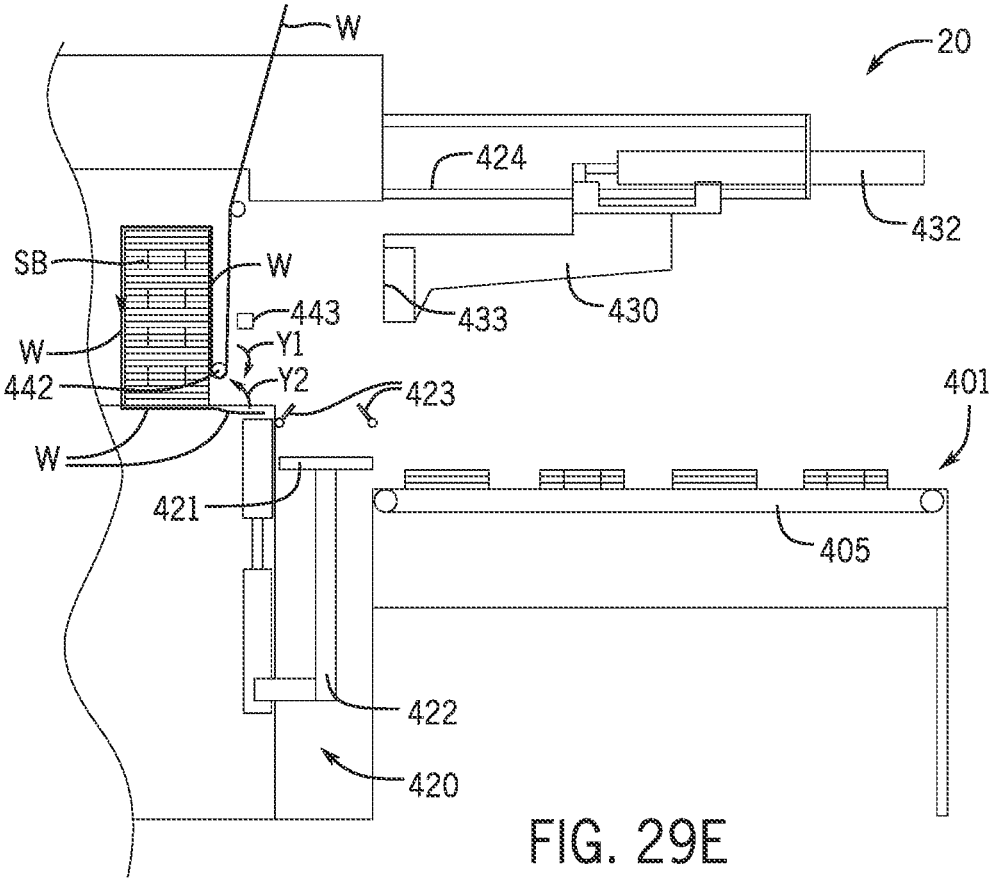
Figure 30A:
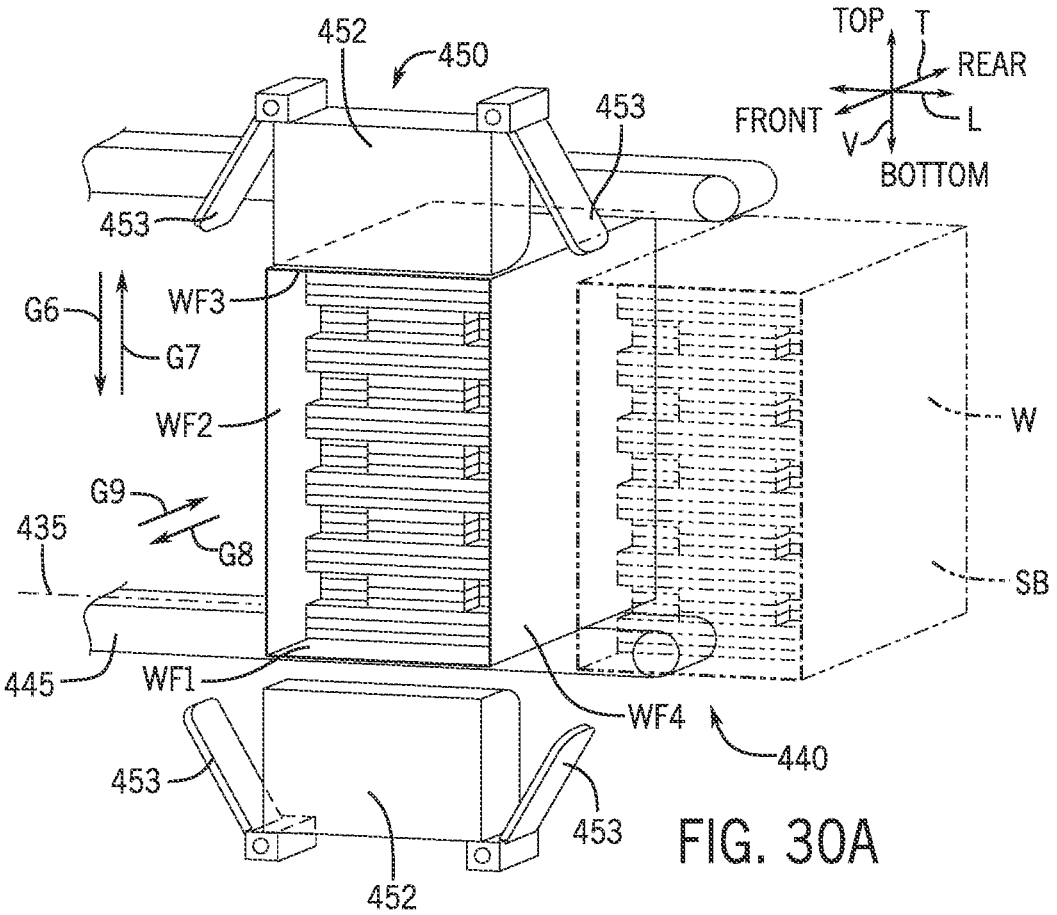
FIGS. 30A-30D are schematic views of a first folding station of the second exemplary folding machine depicted in FIGS. 25-28.
Figure 31A:
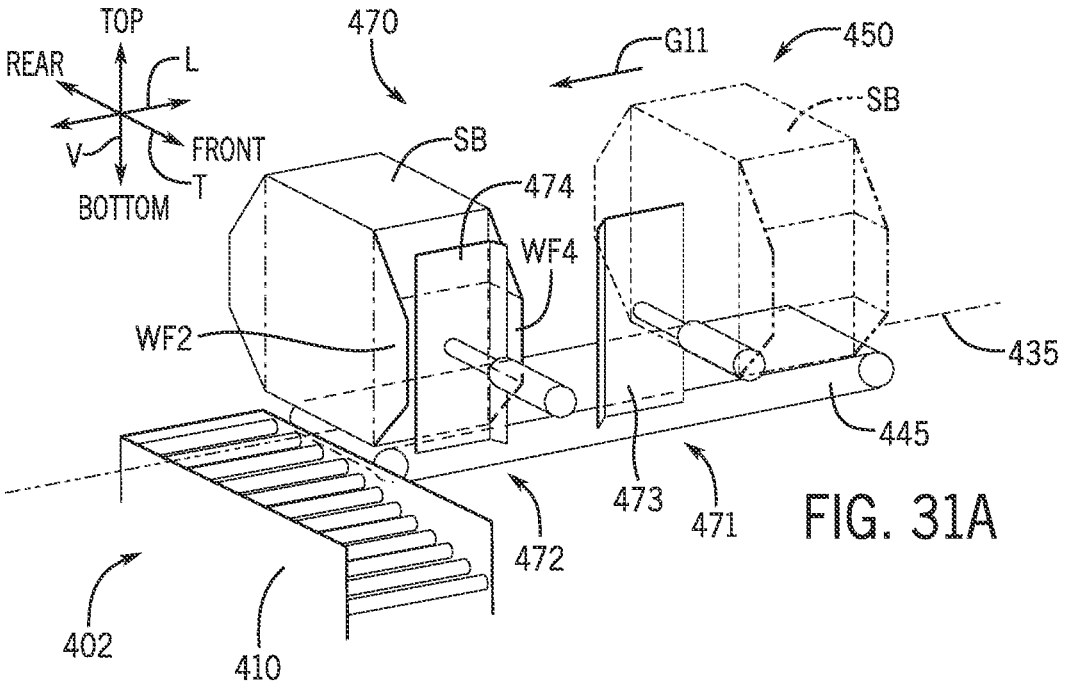
FIGS. 31A-31F are schematic views of a second folding station and an outlet chute of the second exemplary folding machine depicted in FIGS. 25-28.

Referring to FIGS. 29C-29E, operation of the pusher 430 is depicted. The pusher 430 is suspended above the conveyor 405 and is longitudinally movable (see arrows G4, G5) along framing members or rails 424. An actuator 432 moves the pusher 430 along the rails 424. The pusher has a first end 433 that pushes the stack of bags SB supported by the plate 421 and downstream into the wrapping station 440 (see arrow G4) along a longitudinal axis 435 (FIGS. 30A and 31A). After the pusher 430 pushes the stack of bags SB into the wrapping station 440, the actuator 432 moves in the pusher 430 in the opposite direction (see arrow G5).

As the pusher 430 pushes the stack of bags SB off the plate 421, the stack of bags SB contacts and moves into a strip of wrapping W that vertically extends in the wrapping station 440 (see FIGS. 29C-29E). The wrapping W has a first free end that is below the stack of bags SB. As the stack of bags SB is moved into the wrapping station 440, the wrapping W encircles the stack of bags SB on three sides (see FIG. 23D). Referring now to FIG. 29E, a device 442 (such as a roller assembly or paper guide) vertically downwardly moves to thereby pull additional wrapping W from a supply roll (not shown). A cutter 443 then cuts the wrapping W such that a second free end of the wrapping W falls vertically downwardly alongside the stack of bags SB (see arrow Y1). Adhesive is applied to the first free end of the wrapping W that is below the stack of bags SB and a flap (not shown) moves the first free end of the wrapping W toward the stack of bags SB and the second free end of the wrapping W. The adhesive adheres the free ends to each other such that the wrapping W fully encircles the stack of bags SB and thereby extends along four sides of the stack of bags SB (see also FIG. 32B)

After the wrapping W fully encircles the stack of bags (see FIG. 29E and FIG. 32B), the partially packaged stack of bags SB (see FIG. 32B) is pushed downstream onto a second conveyor 445 by the next subsequent stack of bags SB (see dashed lines on FIG. 30A) that is moved into and processed in the wrapping station 440 (as described above).

Referring now to FIGS. 30A-30D, the first folding station 450 folds at least one wrapping flap WF1-WF4 onto the uncovered or exposed sides of the stack of bags SB. Note that although FIGS. 30A-30D depict only the front side of stack of bags SB and the front of the first folding station 450, the opposite rear side of the stack of bags SB and the wrapping flaps WF1'-WF4' extending therefrom are folded onto the rear side of the stack of bags SB in a similar manner with components at the rear of the first folding station 450 as described hereinbelow with respect to the wrapping flap WF1-WF4 extending from the front side of the stack of bags SB.

Figure 25:
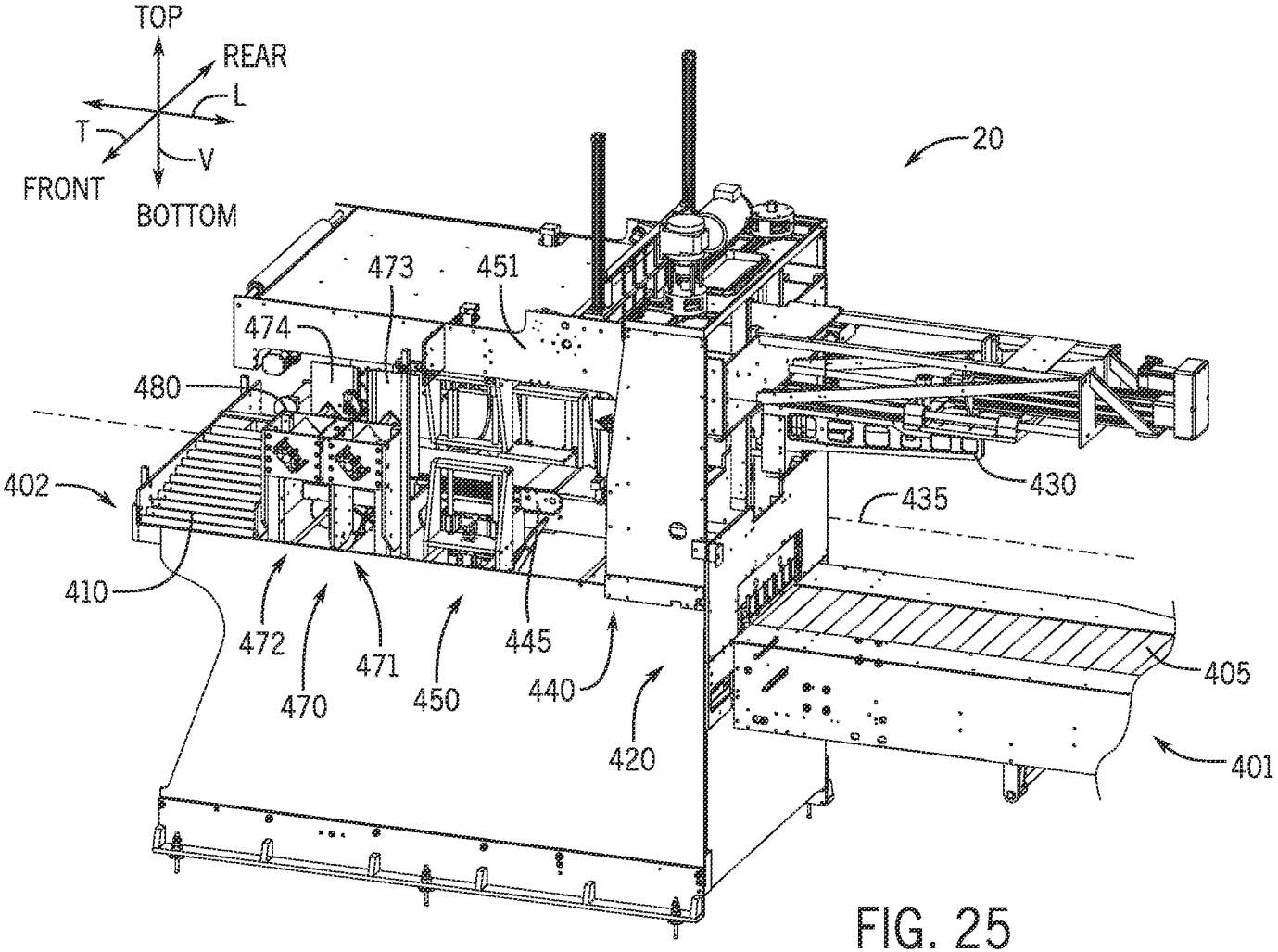
FIGS. 25-27 are perspective views of a second exemplary folding machine of the present disclosure.
Figure 26:
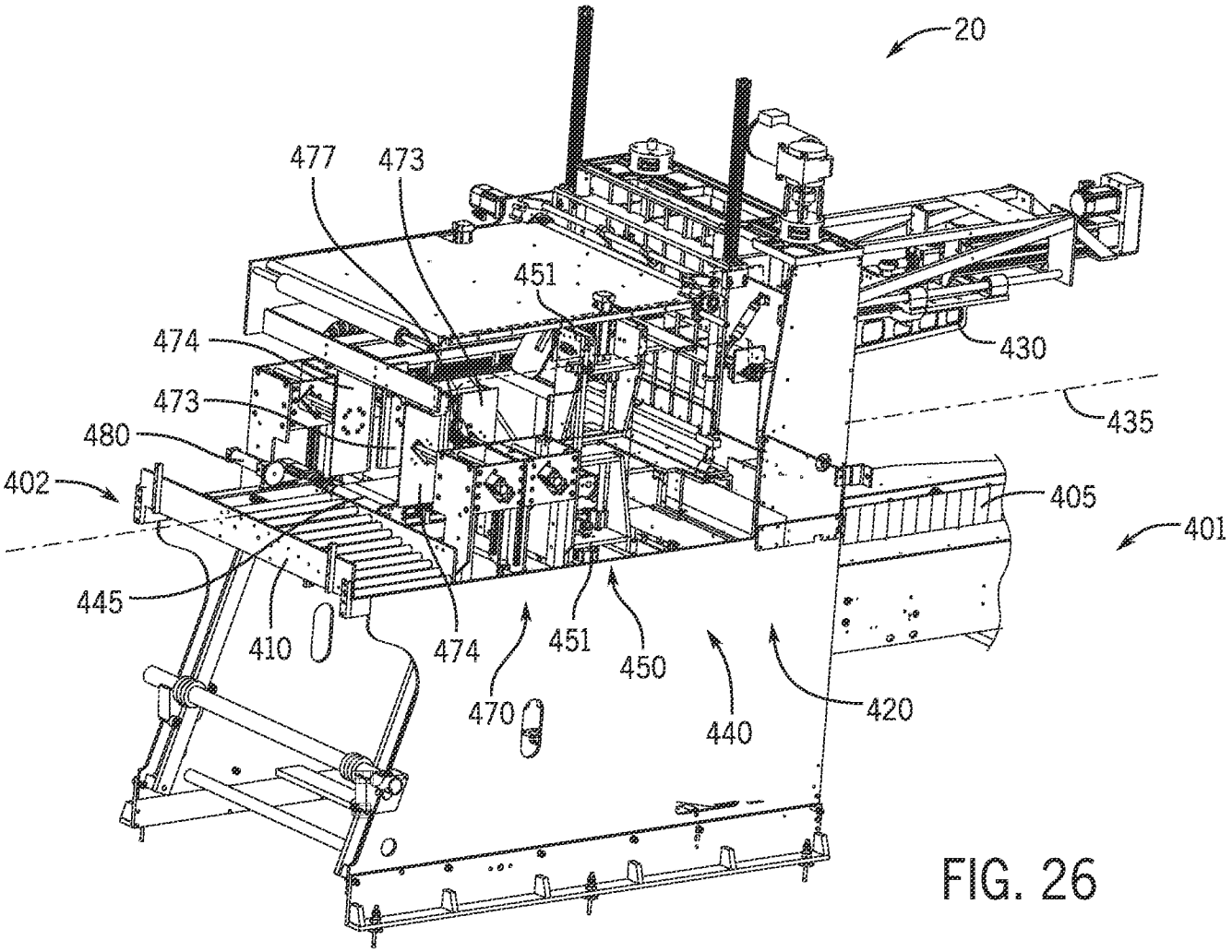
Figure 27:
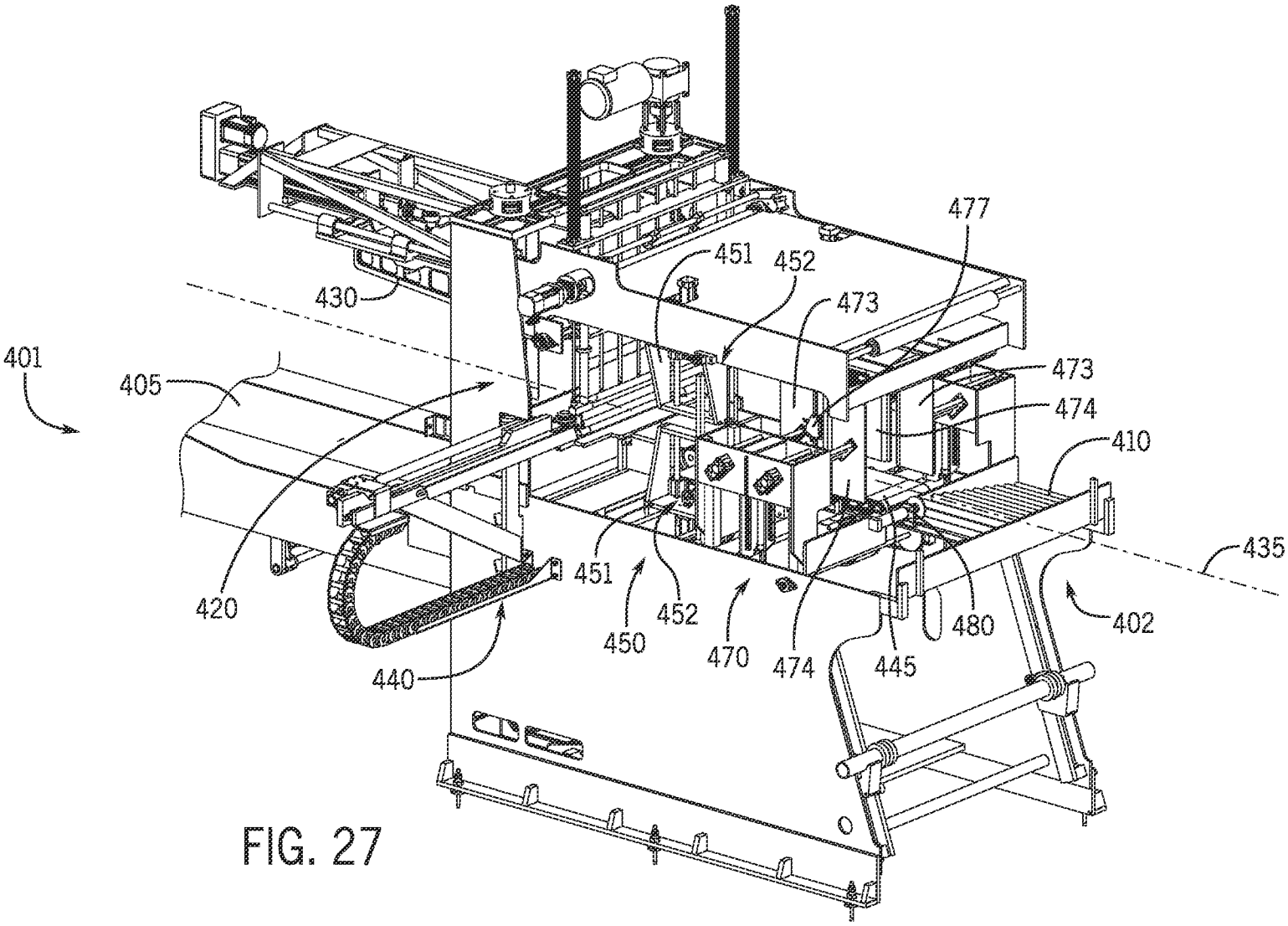
Figure 28:
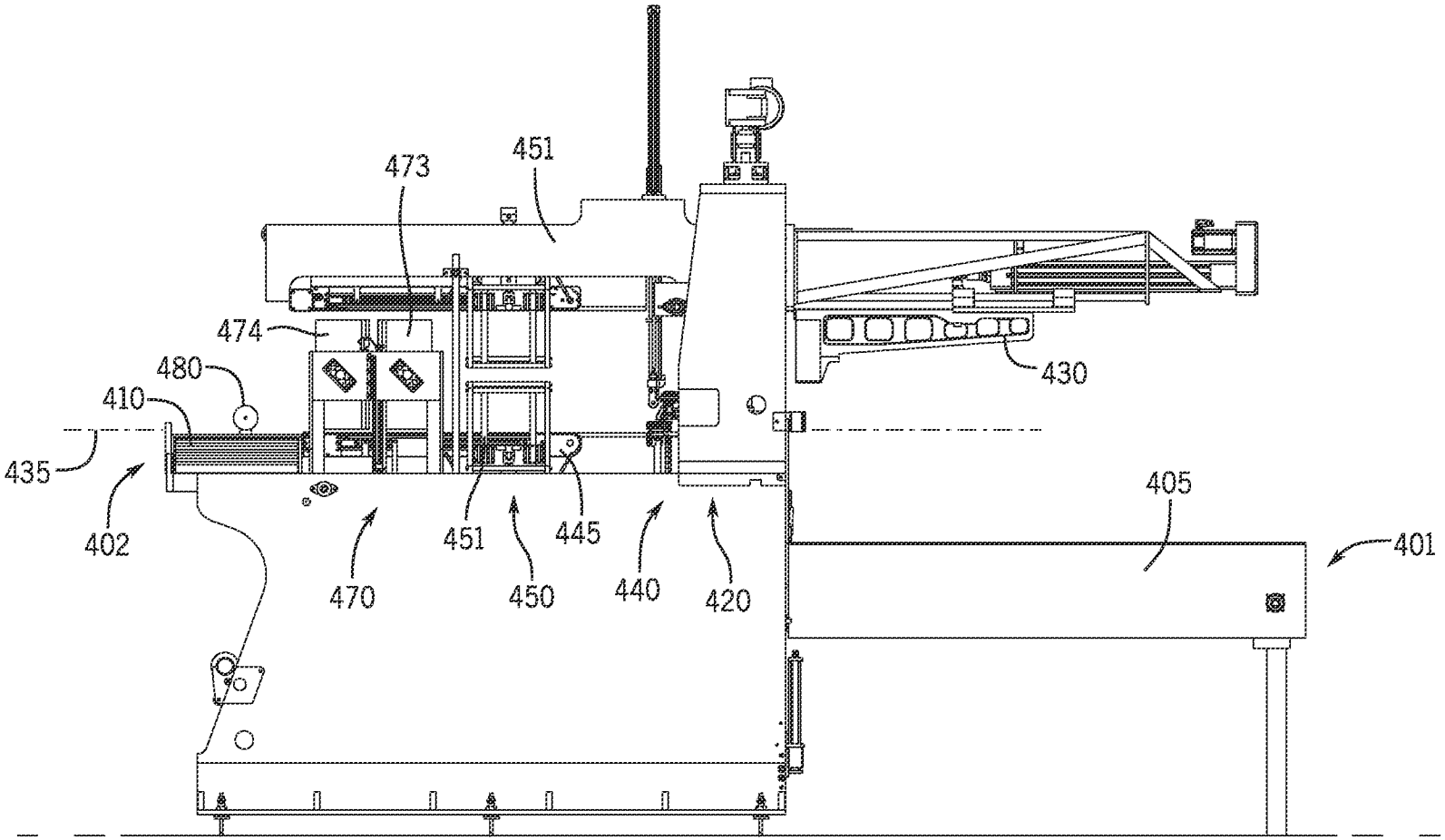
FIG. 28 is a side view of the second exemplary folding machine of the present disclosure.

The first folding station 450 includes a frame 451 (FIG. 25) that supports moveable bullnoses 452 and corresponding paddles 453. The two bullnoses 452 depicted in FIGS. 30A-30D are located on the front side of the second conveyor 445 and are aligned with each other along a vertical axis (not shown). Note that a second pair of bullnoses 452 are also located on the rear side of the second conveyor 445 (see FIG. 27). The bullnoses 452 are vertically (see arrow G6 and G7) and laterally (see arrows G8 and G9) movable along the frame 451 (FIG. 25). The frame 451 can include rails and/or other components along which the bullnoses 452 slide, and one or more actuators (not shown), such as hydraulic pistons or air cylinders, that move the bullnoses 452. The bullnoses 452 are laterally moved (arrow G8, G9) relative to the longitudinal axis 435 and the stack of bags SB such that the position of the bullnoses 452 can be adjusted based on the lateral width of the stack of bags SB. Thus, the first folding station 450 can process stacks of bags SB (and the corresponding wrapping flaps WF1-WF4) having different sizes and shapes.

The bullnoses 452 are also vertically movable (see arrow G6, G7) to thereby fold the first wrapping flap WF1 and the third wrapping flap WF3 onto the uncovered or exposed side of the stack of bags SB (see FIG. 32B), as will be described hereinbelow. FIG. 30A depicts the bullnoses 452 in a retracted position and the stack of bags SB moved into alignment with the bullnoses 452 by the second conveyor 445.

Figure 30B:
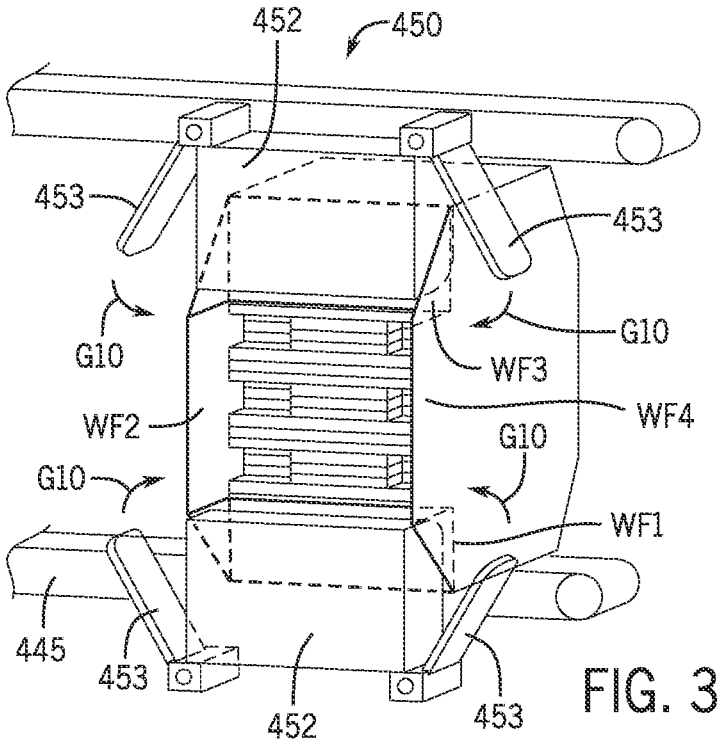
Figure 30C:
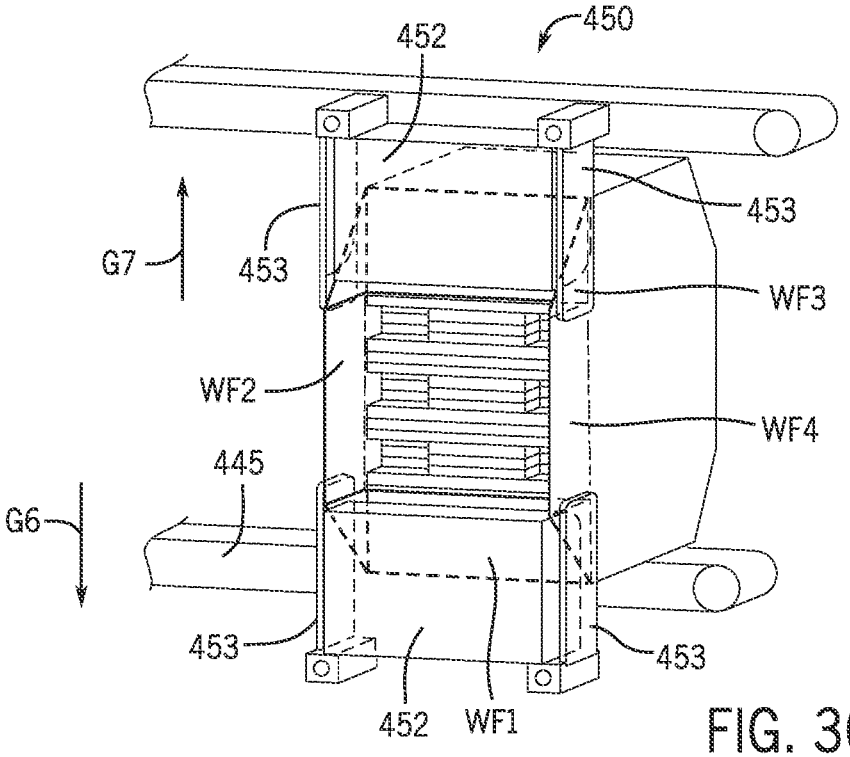

FIG. 30B depicts the bullnoses 452 moved into extended positions in which the bullnoses 452 extend along the uncovered or exposed side of the stack of bags SB. As the bullnoses 452 are moved from the retracted positions (FIG. 30A) to the extended positions (FIG. 30B), the exterior surface of the bullnoses 452 that face the stack of bags SB contacts and pushes (e.g., folds) the first wrapping flap WF1 and the third wrapping flap WF3 toward the uncovered or exposed side of the stack of bags SB (as depicted by the dashed lines in FIG. 30B).

Figure 30D:
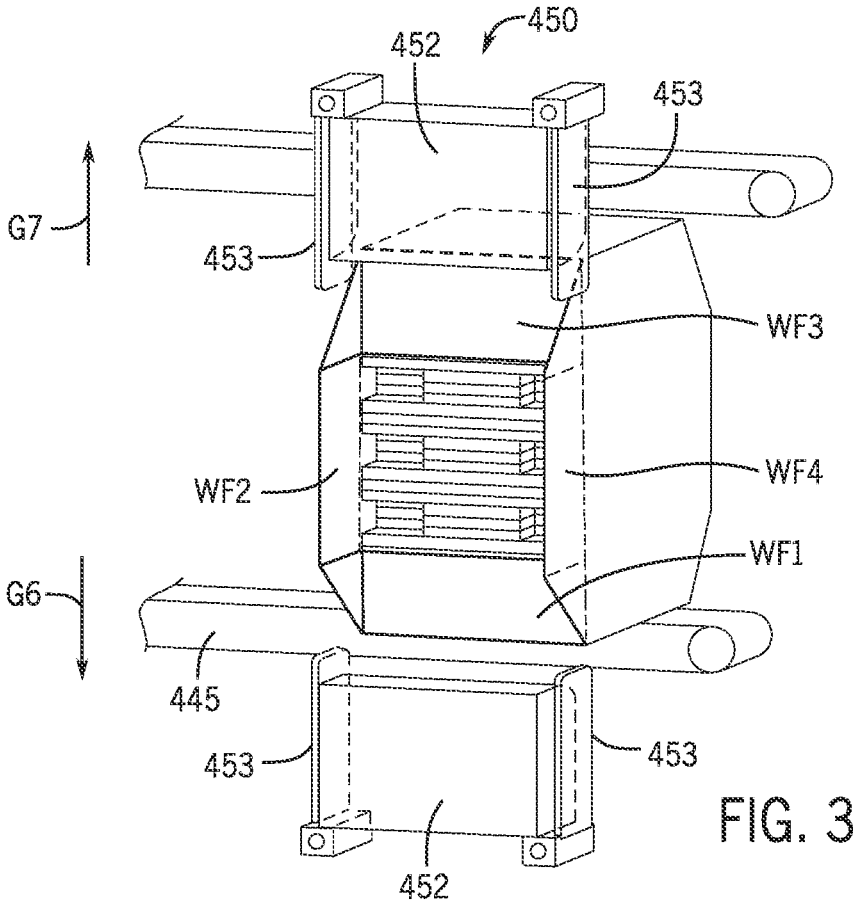

Referring to FIG. 30D, after the bullnoses 452 are moved in the extended position (FIG. 30B), the paddles 453 along the side surfaces (e.g., the surfaces that face in a longitudinal direction) of the bullnoses 452 are moved from an open position (FIG. 30B) to a closed position (FIG. 30C) (see arrows G10). As such, the paddles 453 push the wrapping W (e.g., the second wrapping flap WF2 and the fourth wrapping flap WF4) toward the side surfaces of the bullnoses 452. Note that the paddles 453 pivot about a pivot axis (not shown) that laterally extends.

While the paddles 453 are in the closed position (FIG. 30C) the bullnoses 452 are vertically moved (see FIGS. 30C and 30D and arrows G6 and G7) toward the retracted position such that creases are formed in the wrapping W due the paddles 453 pushing the wrapping toward the side surfaces of the bullnoses 452. After the bullnoses 452 are in the retracted position, the paddles 453 are moved into the open position (FIG. 30A) such that a subsequent stack of bags and the corresponding wrapping flaps can be processed as described able).

Note that the actuators (not shown) that moves the bullnoses 452 are controlled by a controller 200 (FIG. 23). The controller 200 controls the actuators based on the dimensions of the stack of bags SB. The dimensions of the stack of bags SB can be determined in any suitable manner such as: the dimensions are predetermined and stored on the memory 202 of the controller 200, the dimensions are received via a user input 215 (FIG. 23), and/or determined by sensors 205 that are coupled to the controller 200 and configured to sense dimensions of the stack of bags SB. Based on the dimensions of the stack of bags SB, the controller 200 controls the actuators to move the bullnoses 452 toward or away from the stack of bags SB and the axis 435. For example, if the dimension of the stack of bags SB in the lateral direction is small, the actuators move the bullnoses 452 toward the stack of bags SB so that the wrapping flaps are properly (e.g., tightly) folded onto the end of the stack of bags SB.

With the first wrapping flap WF1 and the third wrapping flap WF3 folded onto the uncovered or exposed side s of the stack of bags SB (as depicted in FIG. 30D), the second conveyor 445 conveys the stack of bags SB downstream (see arrow G11) to a second folding station 470 as depicted in FIG. 31A. Note that for reference the position of the stack of bags SB in the first folding station 450 is depicted is dashed lines in FIG. 31A.

Figure 31B:
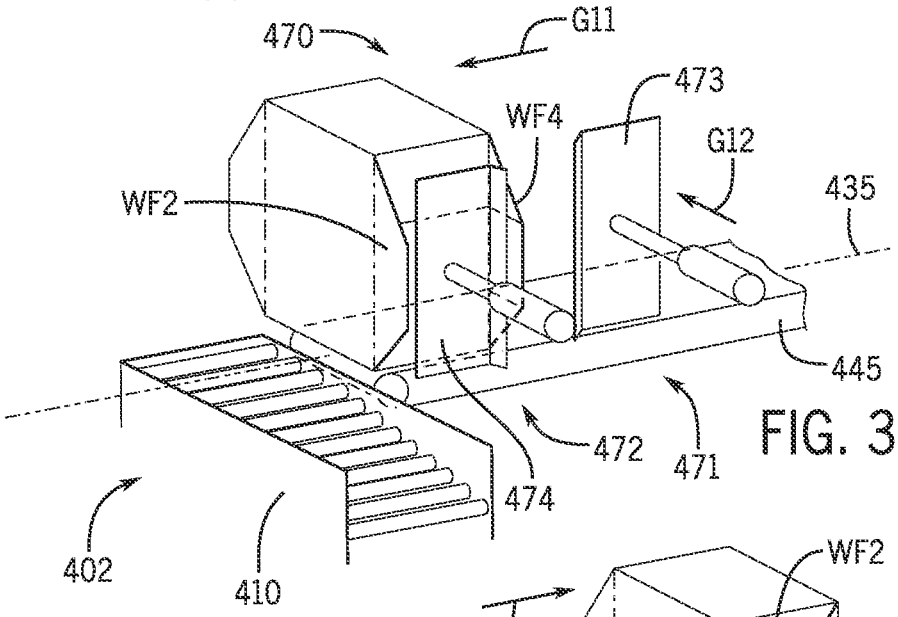

The second conveyor 445 conveys the stack of bags SB past an upstream position 471 (FIG. 31C) into a downstream position (FIG. 31B). Note that folding plates 473, 474 are each in retracted positions such that these plates 473, 474 are laterally offset from the second conveyor 445 and the unfolded wrapping flaps (e.g., the second wrapping flap WF2 and the fourth wrapping flap WF4) pass by the folding plate 473, 474.

Figure 31C:
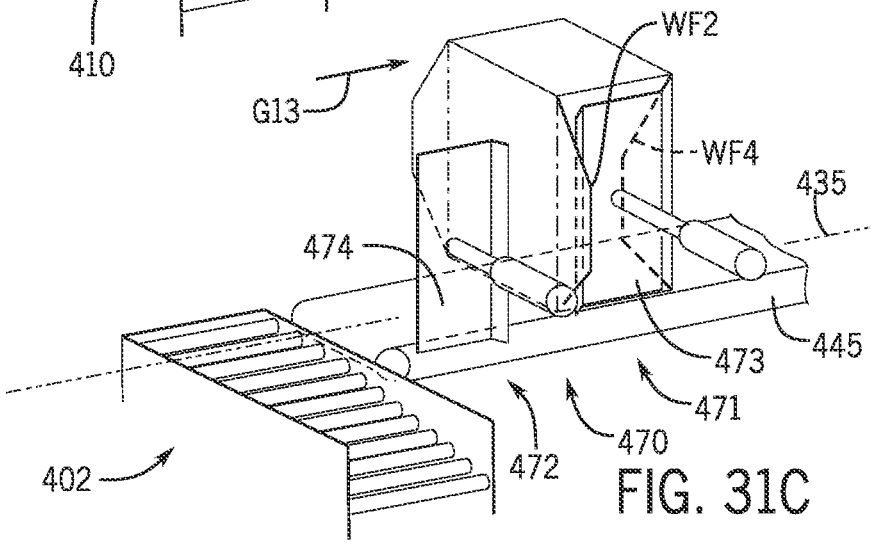

Referring now to FIG. 31B, after the stack of bags SB is conveyed to the downstream position 471 by the second conveyor 445 (see arrow G11), the upstream folding plate 473 is laterally moved by an actuator (not shown) toward the second conveyor 445 (see arrow G12). Next the second conveyor 445 moves the stack of bags SB upstream (see arrow G13 on FIG. 31C), and as the stack of bags SB is moved upstream (see arrow G13) into the upstream position 471, the fourth wrapping flap WF4 contacts the upstream folding plate 473. As such, the fourth wrapping flap WF4 is folded onto the end of the stack of bags SB as depicted in FIG. 31C (note that the fourth wrapping flap WF4 is depicted in dashed lines on FIG. 31C).

Figure 31D:
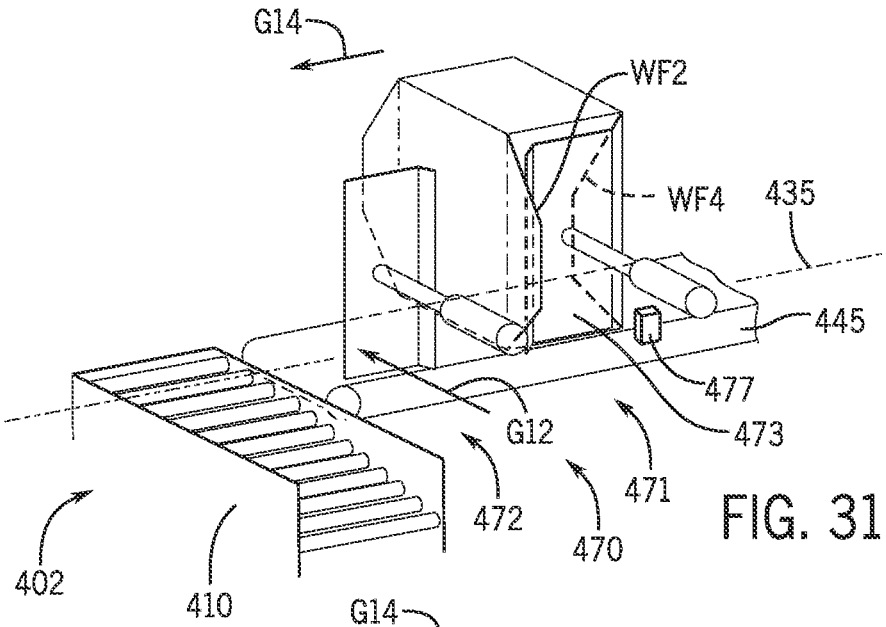
Figure 31E:
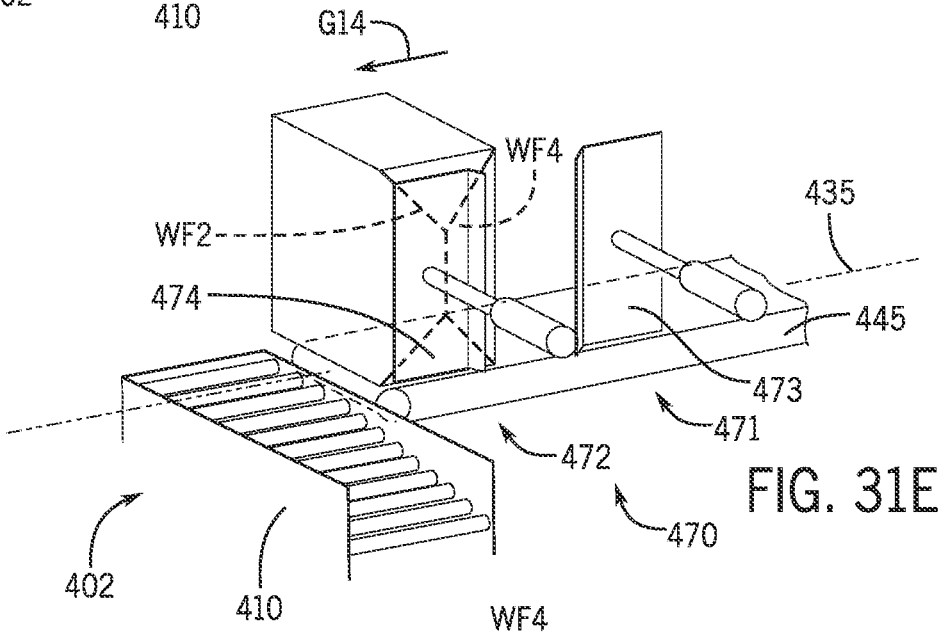
Figure 31F:
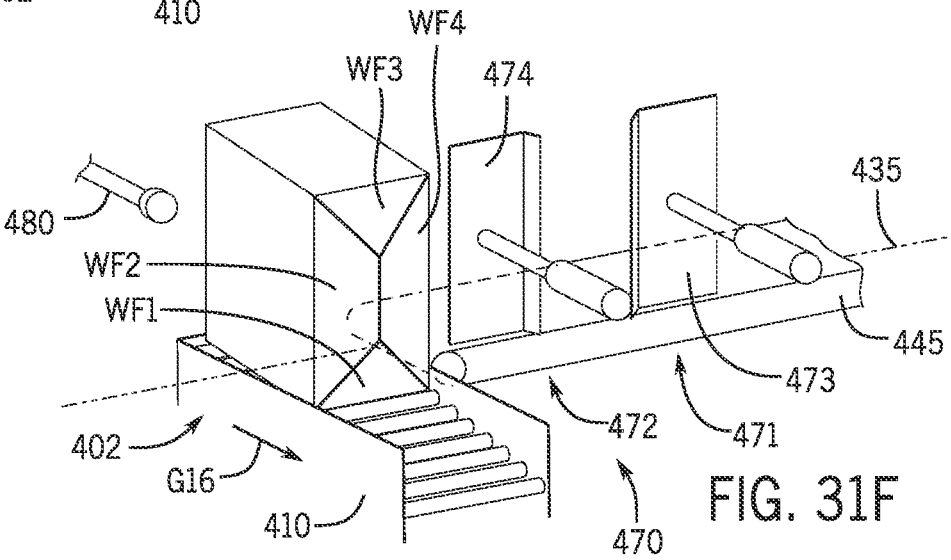

Referring to FIG. 31D, the downstream folding plate 474 is then laterally moved by an actuator (not shown) toward the second conveyor 445 (see arrow G12). The second conveyor 445 then moves the stack of bags SB downstream (see arrow G14), and as the stack of bags SB is moved downstream (see arrow G14) into the downstream position 472, the second wrapping flap WF2 contacts the downstream folding plate 474. As such, the second wrapping flap WF2 is folded onto the uncovered or exposed side of the stack of bags SB as depicted in FIG. 31E (note that the second wrapping flap WF2 is depicted in dashed lines on FIG. 31E). Note that an optional adhesive applicator 477 (FIG. 31D) applies adhesive to the second wrapping flap WF2 before the second wrapping flap WF2 is folded as described above. The adhesive secures the wrapping flaps WF1-WF4 along the uncovered or exposed side of the stack of bags SB. The adhesive applicator 477 can be any suitable device configured to apply adhesive to the wrapping flap such as a roller or sprayer. In certain examples, the adhesive applicator 477 is vertically moved by an actuator (not shown) along a frame or rail (see arrow G15). The folding plates 473, 474 are moved back to the retracted position (see FIG. 31A) such that the next subsequent stack of bags SB can be processed in the second folding station 470 as described above.

After the wrapping flaps WF1-WF4 are secured along the side of the stack of bags SB the stack of bags SB is fully packaged in the wrapping W. Accordingly, the second conveyor 455 further conveys the stack of bags SB to an outlet chute 410 that conveys the packaged stack of bags SB to another station (not shown) such as a shipping station or palleting station. The chute 410 can be a sloped ramp or be made of rollers. Alternatively, the outlet chute 410 is a conveyor that conveys the stack of bags SB. In certain examples, a device 480 (FIG. 31F) pushes the stack of bags SB along the chute 410 (see arrow G16).

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for end-folding a wrapping onto a stack of bags, the system comprising:

a folding machine having:

a first folding station configured to receive the stack of bags with the wrapping partially covering the stack of bags such that the wrapping has a plurality of wrapping flaps extending outwardly from the stack of bags, the first folding station includes:

a first bullnose and a second bullnose that selectively move toward or away from each other;

a first pair of paddles coupled to and moveable with the first bullnose, the first pair of paddles configured to push the wrapping toward the first bullnose; and a second pair of paddles coupled to and moveable with the second bullnose, the second pair of paddles configured to push the wrapping toward the second bullnose;

wherein the first bullnose and the second bullnose are moved toward each other and configured to thereby end-fold a first wrapping flap and a second wrapping flap onto the stack of bags thereby leaving at least one wrapping flap unfolded; and wherein after the first bullnose and the second bullnose are moved toward each other, the first pair of paddles are moved to thereby push the wrapping toward the first bullnose and the second pair of paddles are moved to thereby push the wrapping toward the second bullnose such that as the first bullnose and the second bullnose are moved away from each other creases are formed in the wrapping between the folded first and second wrapping flaps and the unfolded wrapping flaps; and a second folding station downstream from the first folding station that is configured to receive the stack of bags from the first folding station and further configured to end-fold the at least one unfolded wrapping flaps onto the stack of bags.

2. The system according to claim 1, further comprising a conveyor configured to convey the stack of bags or portions thereof to the folding machine.

3. The system according to claim 1, wherein the folding machine has a conveyor configured to convey the stack of bags from the first folding station to the second folding station.

4. The system according to claim 1, wherein the folding machine further comprises a wrapping station having a pusher configured to push the stack of bags downstream along an axis into the wrapping that vertically extends in the wrapping station such that the wrapping encircles the stack of bags and further push the wrapped stack of bags downstream onto a conveyor that is configured to convey the wrapped stack of bags to the first folding station and the second folding station.

5. The system according to claim 1, wherein the folding machine has a conveyor configured to convey the stack of bags downstream to the second folding station; and wherein the second folding station includes:

a first folding plate that is moved toward the conveyor and is thereby configured to end-fold one of the unfolded wrapping flaps onto the stack of bags; and a second folding plate that is moved toward the conveyor and is thereby configured to end-fold another one of the unfolded wrapping flaps onto the stack of bags, wherein the second folding plate is downstream from the first folding plate.

6. The system according to claim 5, wherein the conveyor is configured to convey the stack of bags upstream such that the first folding plate end-folds one of the unfolded wrapping flaps onto the stack of bags and then subsequently convey the stack of bags downstream such that second folding plate end-folds another one the unfolded wrapping flaps onto the stack of bags.

7. The system according to claim 5, wherein the first folding plate and the second folding plate are movable relative to an axis along which the stack of bags is moved, and wherein the first folding plate and the second folding plate are moved relative to the axis based on dimensions of the stack of bags such that the wrapping flaps are end-folded onto the stack of bags.

8. The system according to claim 7, further comprising a controller that controls one or more actuators that move the first folding plate and the second folding plate.

9. The system according to claim 8, wherein the controller controls the actuators based on the dimensions of the stack of bags, and wherein the dimensions of the stack of bags are stored on a memory of the controller, received via a user input, or determined by sensors that are coupled to the controller and configured to sense dimensions of the stack of bags.

10. The system according to claim 1, wherein the first bullnose and the second bullnose are movable relative to an axis along which the stack of bags is moved, and wherein the first bullnose and the second bullnose are moved relative to the axis based on dimensions of the stack of bags such that the first and second wrapping flaps are end-folded onto the stack of bags.

11. The system according to claim 10, further comprising a controller that controls one or more actuators that move the first bullnose and the second bullnose relative to the axis.

12. The system according to claim 11, wherein the controller controls the actuators based on the dimensions of the stack of bags, and wherein the dimensions of the stack of bags are stored on a memory of the controller, received via a user input, or determined by sensors that are coupled to the controller and configured to sense dimensions of the stack of bags.

* * * * *